US006937213B2

(12) United States Patent
Iwasa et al.

(10) Patent No.: US 6,937,213 B2
(45) Date of Patent: Aug. 30, 2005

(54) METHOD AND DEVICE FOR DRIVING PLASMA DISPLAY PANEL

(75) Inventors: Seiichi Iwasa, Kawasaki (JP); Kenji Awamoto, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 375 days.

(21) Appl. No.: 10/028,367

(22) Filed: Dec. 28, 2001

(65) Prior Publication Data

US 2002/0122016 A1 Sep. 5, 2002

(30) Foreign Application Priority Data

Mar. 2, 2001 (JP) ..... 2001-057618
Aug. 31, 2001 (JP) ..... 2001-263684

(51) Int. Cl.[7] ..... G09G 3/28
(52) U.S. Cl. ..... 345/60; 345/60
(58) Field of Search ..... 345/88–104, 60–72, 345/169.3, 168.4; 315/167, 168, 169.1, 169.4

(56) References Cited

U.S. PATENT DOCUMENTS 3,754,230 A * 8/1973 Auger ..... 345/69
5,745,086 A 4/1998 Weber
6,686,912 B1 * 2/2004 Kishi et al. ..... 345/211

* cited by examiner

*Primary Examiner*—Dennis-Doon Chow
*Assistant Examiner*—Aaron S. Ward
(74) *Attorney, Agent, or Firm*—Staas & Halsey LLP

(57) ABSTRACT

A method and device for driving a plasma display panel is provided in which a drop of an increasing voltage rate due to discharge is prevented, and a reset period is shortened. In driving a plasma display panel by applying an increasing voltage to cells of a display screen during a reset period for equalizing charge of the cells, an increasing voltage signal is supplied to an impedance conversion circuit in which an output impedance is lower than an input impedance, and the output signal of the impedance conversion circuit is supplied to the cells.

18 Claims, 25 Drawing Sheets

METHOD AND DEVICE FOR DRIVING PLASMA DISPLAY PANEL

BACKGROUND OF THE INVENTION

1. Field of the Invention

The present invention relates to a method and a device for driving a plasma display panel (PDP).

In an AC type PDP, before addressing for forming a charge distribution in accordance with display data, charge is equalized in all cells. Quality of the equalization affects the success or failure of the addressing. In order to improve quality of a display, it is desired to realize a driving method in which precise equalization can be performed in a short time.

2. Description of the Prior Art

In an AC type PDP, a memory function of a dielectric layer covering display electrodes is utilized. In other words, charge quantity of a cell is controlled in accordance with display data in the addressing, and then a sustaining voltage Vs having alternating polarities is applied to a pair of display electrodes. The sustaining voltage Vs satisfies the following inequality.

$$Vf-Vw<Vs<Vf$$

Here, Vf denotes a discharge start voltage, and Vw denotes a wall voltage between electrodes.

When the sustaining voltage Vs is applied, a cell voltage (an effective voltage of a voltage applied to the electrode plus the wall voltage) exceeds the discharge start voltage Vf and display discharge is generated only in cells having the wall charge. "Lighting" means to emit light by display discharge. In general, an application period of the sustaining voltage Vs is approximately several microseconds, and the light emission looks continuous. Since the cell of a PDP is a binary light emission element, a half tone is reproduced by setting the number of discharge times in one frame in accordance with a gradation level for each cell. A color display is one type of a gradation display, and a display color is determined by combining luminance levels of three primary colors. The gradation display is realized by making one frame of plural subframes having a luminance weight and by setting the number of total discharge times by combining on and off of lighting for each subframe. In the case of an interlace display, each of plural fields of a frame includes plural subfields, and the lighting control is performed for each subfield. However, contents of the lighting control are the same as that in a progressive display.

Adding to an address period for addressing and a display period (or a sustain period) for generating display discharge plural times in accordance with the luminance weight, a reset period for an initialization is assigned to the subframe so as to equalize charged state of a whole screen before the addressing. At the end of the display period, some cells have relatively much wall charge, and other cells have little wall charge. Therefore, in order to improve reliability of a display, the initialization is performed as an addressing preparation process.

U.S. Pat. No. 5,745,086 discloses an initialization step in which a first and a second ramp voltage are applied to cells sequentially. By applying a ramp voltage having a gentle gradient, light emission quantity in the initialization can be decreased because of characteristics of microdischarge that will be explained below. Thus, drop of contrast is prevented, and the wall voltage can be set to any target value despite of variation of cell structures.

When a ramp voltage having an increasing amplitude is applied to a cell having appropriate quantity of wall charge, microdischarge is generated plural times while the applied voltage increase if the gradient of the ramp voltage is gentle. As the gradient is made further gentle, discharge intensity is decreased and the discharge period is shortened so as to transfer to a continuous discharge form. In the following explanation, periodic discharge and continuous discharge are collectively called "microdischarge". In the microdischarge, the wall voltage can be set only by a peak voltage value of the ramp waveform. It is because that during the microdischarge even if a cell voltage Vc (=the wall voltage Vw+an applied voltage Vi) applied to a discharge space exceeds a discharge start threshold level (hereinafter, denoted by Vt) as the ramp voltage increases, the cell voltage is always kept at the vicinity of the voltage Vt due to the microdischarge. The microdischarge drops the wall voltage by the same level as the increased level of the ramp voltage. When the final value of the ramp voltage is denoted by Vr and the wall voltage when the ramp voltage reaches the final value Vr is denoted by Vw, the following relationship is satisfied since the cell voltage Vc is maintained at the voltage Vt.

$$Vc=Vr+Vw=Vt$$

Therefore, $Vw=-(Vr-Vt)$

Since the voltage Vt has a constant value that is determined by electric characteristics of a cell, the wall voltage can be set to any target value by setting the final value Vr of the ramp voltage. In other words, even if there is a minute difference in the voltage Vt between cells, the difference between the voltage Vt and the voltage Vw can be equalized in all cells.

In the initialization for generating microdischarge, a first ramp voltage is applied so as to form appropriate quantity of wall charge between the display electrodes. After that, a second ramp voltage is applied so as to make the wall voltage between the display electrodes close to the target value.

FIG. 24 is a schematic diagram of the conventional driving circuit. In the conventional method, as means for applying a ramp voltage, there is used constant-current circuits 911 and 921 each of which combines a field-effect transistor (FET) and a resistor. In the constant-current circuit 911 for applying a ramp voltage of the positive polarity, the drain of the FET is connected to an electrode of a cell, and the source of the FET is connected to a power source of a potential +V via a resistor. The gate of the FET is supplied with an on/off control signal S10 via a driver 912. The driver 912 includes an isolator 913 such as a photocoupler and converts the on/off control signal S10 into a signal with respect to the power source potential +V. When the gate of the FET is biased so that the FET is turned on, a current flows from the power source to the cell. The resistor restricts the current, and a constant current $I_C$ is supplied to the cell. Since the cell is a capacitive load $C_L$ to the power source when discharge is not generated, the supply of the constant current increases the voltage applied to the cell at a substantially constant rate. When a ground circuit 930 is activated, charge of the load $C_L$ is discharged to the ground line, so that the electrode potential becomes the ground potential. The constant-current circuit 921 for applying a ramp voltage of the negative polarity has substantially the same structure as that of the constant-current circuit 911 except the polarity of the FET. The constant-current circuit 921 is supplied with an on/off control signal S20 via a driver 922. The driver 922 includes an isolator 923 and converts the on/off control signal S20 into a signal with respect to the power source potential −V. When the FET is turned on, a current $I_C$ flows from the display electrode to the power source, so that the voltage having the negative polarity applied to the cell increases at a substantially constant rate.

As a concrete example, it is supposed that the output voltage of the driver 912 is 10 volts, the threshold level voltage between the gate and the source of the FET is 3 volts and resistance of the resistor is 50 ohms. In this case, the output current $I_C$ of the constant-current circuit 911 is (10−3)/50=0.14 amperes. If capacitance of the load $C_L$ is 0.14 microfarads, gradient of the ramp waveform is $dV/dt=I_C/C_L=1$ volt per microsecond. This means that the ramp voltage increasing from zero volts reaches 200 volts 200 microseconds after the start of the increasing.

FIG. 25 shows a transition of the driving voltage in the conventional method.

Before microdischarge is generated, capacitance of the load is charged by the whole current supplied from the constant-current circuit. When microdischarge starts, a part of the supplied current becomes a discharge current, so that the current for charging the capacitance decreases. Therefore, the rate of increase in the applied voltage, i.e., the gradient of the ramp waveform is not constant but alters in accordance with whether discharge is generated or not.

In the initialization as an addressing preparation of a certain subframe, if all cells were off (not lighted) in the adjacent subframe (hereinafter, referred to as the previous subframe), the cells have little wall charge at the start of the initialization. Therefore, discharge starts when the applied voltage becomes close to the final value +V. Accordingly, the time Tp1 until the applied voltage reaches the final value +V is relatively short. In the case of the above-mentioned concrete example, the time Tp1 is 200 microseconds. On the contrary, if all cells were lighted in the previous subframe, the cells have residual wall charge at the start of the initialization. Therefore, discharge starts when the applied voltage is still low. For this reason, the time Tp2 until the applied voltage reaches the final value +V is relatively long. For example, microdischarge starts when the applied voltage reaches 100 volts. When the gradient of the ramp waveform decreases from 1 volts per microsecond to 0.5 volts per microsecond, the time Tp2 becomes 300 microseconds.

A pulse width (i.e., an application period) of the applied voltage pulse is set in accordance with the time Tp2. Since the gradient of the ramp waveform varies substantially due to discharge in the conventional method, it is difficult to shorten the pulse width, so there is a problem that the initialization requires a long time. It is desirable that the reset period is as short as possible so as to secure a long time that can be assigned to addressing and sustaining.

SUMMARY OF THE INVENTION

An object of the present invention is to prevent the rate of increase in an increasing voltage from dropping due to discharge and to shorten the reset period.

The method according to the present invention is for driving a plasma display panel by applying an increasing voltage to cells of a display screen. The method includes the step of supplying the increasing voltage signal outputted by a circuit for determining a waveform of the applied voltage to the cells via an impedance conversion circuit for generating a voltage signal with low impedance. Thus, setting of the waveform is separated form supplying power substantially, so that a desired voltage can be applied to cells regardless of the supplied current quantity.

In the period while the voltage is not applied, the input and the output of the impedance conversion circuit are connected to each other. Thus, it is prevented that the impedance conversion circuit becomes a load to other driving circuits.

DESCRIPTION OF THE PREFERRED EMBODIMENTS

Hereinafter, the present invention will be explained more in detail with reference to embodiments and drawings.

Figure 1:
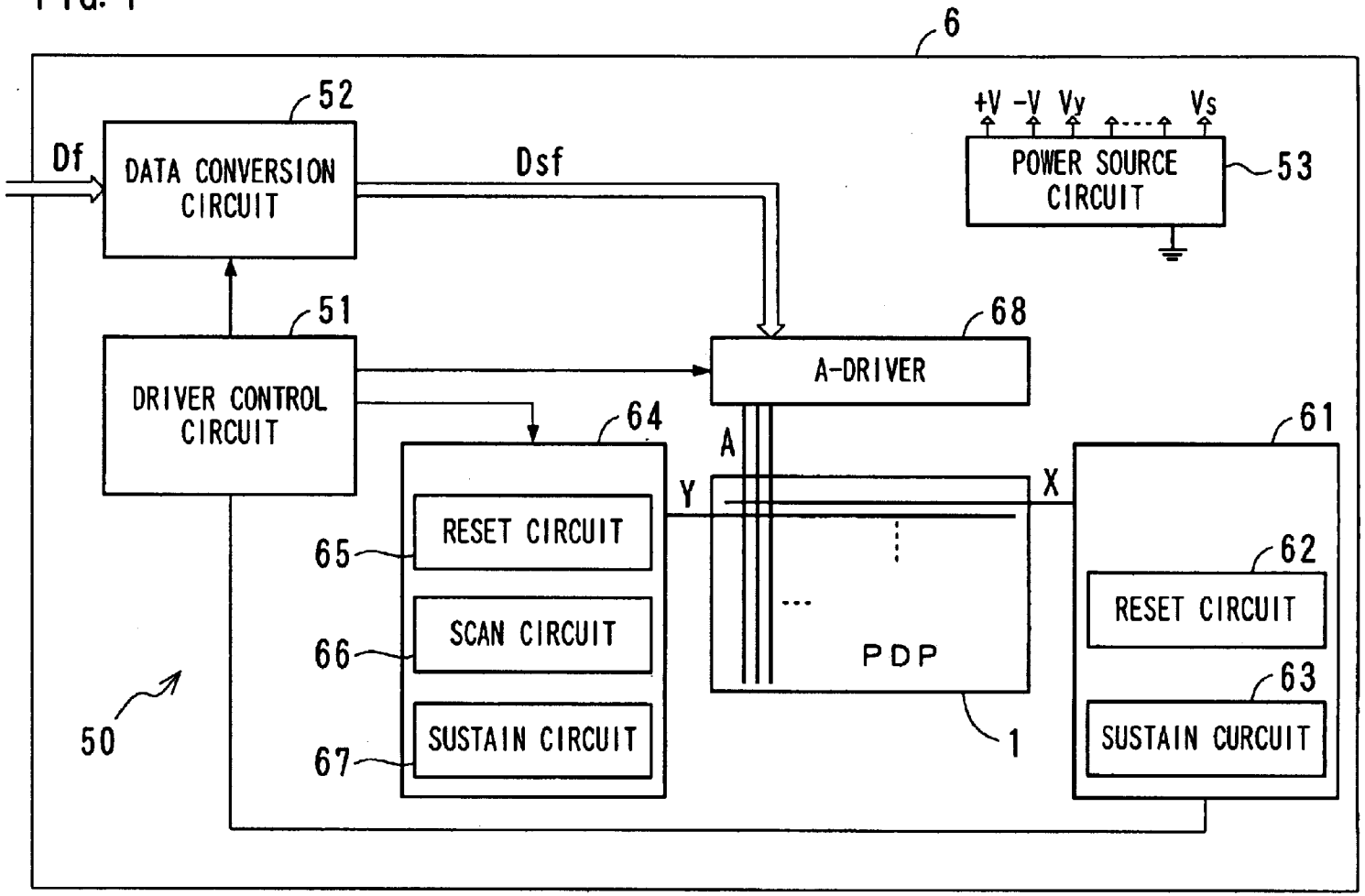
FIG. 1 is a schematic diagram of a display device according to the present invention.

FIG. 1 is a schematic diagram of a display device according to the present invention. The display device 6 comprises a surface discharge type PDP 1 including a display screen having m×n cells and a drive unit 50 for lighting cells arranged in a matrix selectively. The display device 6 is used as a wall-hung television set or a monitor of a computer system.

The PDP 1 has display electrodes X and Y arranged in parallel constituting electrode pairs for generating display discharge and address electrodes A arranged so as to cross the display electrodes X and Y. The display electrodes X and Y extend in the row direction (in the horizontal direction) of the screen , while the address electrodes extend in the column direction (in the vertical direction).

The drive unit 50 includes a driver control circuit 51, a data conversion circuit 52, a power source circuit 53, an X-driver 61, a Y-driver 64 and an A-driver 68. The drive unit 50 is supplied with frame data Df indicating luminance levels of red, green and blue colors as well as various synchronizing signals from an external device such as a TV tuner or a computer. The frame data Df are temporarily memorized in a frame memory of the data conversion circuit 52. The data conversion circuit 52 converts the frame data Df into subframe data Dsf for a gradation display and transmits the subframe data Dsf to the A-driver 68. The subframe data Dsf are a set of display data including one bit per cell, and a value of each bit indicates whether light emission of the cell in the corresponding subframe is necessary or not, more specifically whether address discharge is necessary or not. The X-driver 61 includes a reset circuit 62 for applying a pulse for initialization to the display electrode X and a sustain circuit 63 for applying a sustain pulse to the display electrode X. The Y-driver 64 includes a reset circuit 65 for applying a pulse for initialization to the display electrode Y, a scan circuit 66 for applying a scan pulse to the display electrode Y in addressing and a sustain circuit 67 for applying a sustain pulse to the display electrode Y. The A-driver 68 applies an address pulse to the address electrode A assigned by the subframe data Dsf. Application of a pulse means to bias an electrode temporarily to a predetermined potential.

The driver control circuit 51 controls application of a pulse and transmission of the subframe data Dsf. The power source circuit 53 supplies driving power to a necessary part in the unit.

Figure 2:
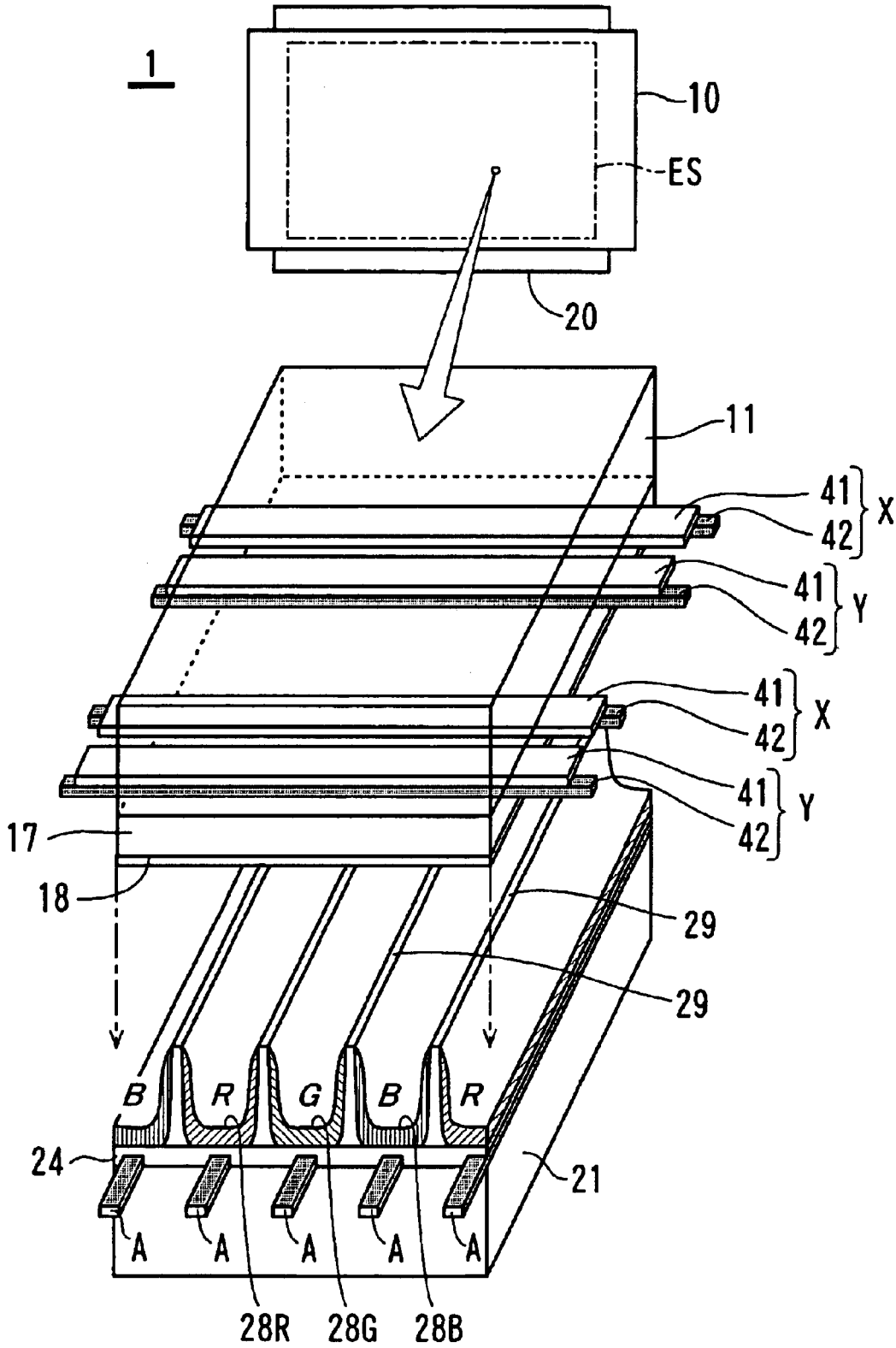
FIG. 2 shows an example of a cell structure of a PDP.

FIG. 2 shows an example of a cell structure of a PDP.

The PDP 1 comprises a pair of substrate structures (including a glass substrate on which cell elements are arranged) 10 and 20. On the inner surface of the front glass substrate 11, display electrodes X and Y are arranged such that a pair of electrodes X and Y is disposed at each row of a display screen ES having n rows and m columns. Each of the display electrodes X and Y includes a transparent conductive film 41 for forming a surface discharge gap and a metal film 42 overlaid on the edge portion of the transparent conductive film 41. The display electrodes X and Y are covered with a dielectric layer 17 and a protection film 18. On the inner surface of the back glass substrate 21, address electrodes A are arranged such that one electrode A is disposed at one column, and these address electrodes A are covered with a dielectric layer 24. On the dielectric layer 24, partitions 29 are arranged for dividing a discharge space into columns. A partition pattern is a stripe pattern. Fluorescent material layers 28R, 28G and 28B for a color display cover the surface of the dielectric layer 24 and the side faces of the partition, and emit light when being excited locally by ultraviolet rays emitted by the discharge gas. Italic letters R, G and B in FIG. 2 indicate light emission colors of the fluorescent materials. The color arrangement has a repeated pattern of R, G and B in which cells of one column have the same color.

Hereinafter, a method for driving the PDP 1 of the display device 100 will be explained.

Figure 3:
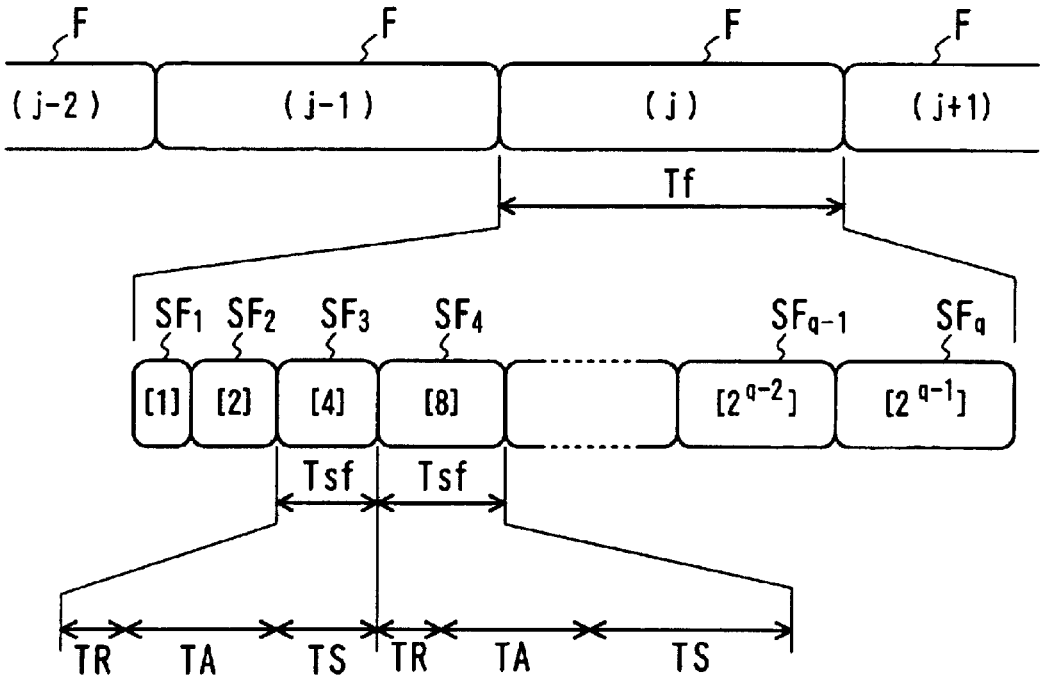
FIG. 3 shows a concept of frame division.

FIG. 3 shows a concept of frame division. In a display using the PDP 1, in order to reproduce a color by binary lighting control, each of sequential frames F of an input image is divided into a predetermined number q of subframes SF. Namely, each frame F is replaced with a set of q subframes SF. These subframes SF are given weight of $2^0$, $2^1$, $2^2$, . . . , $2^{q-1}$ for setting the number of display discharge times in each subframe SF. By combining on and off of the subframes, $N(=1+2^1+2^2+\ldots+2^{q-1})$ steps of luminance can be set for red, green and blue colors. Though the subframe arrangement is in the weight order in FIG. 3, it can be in other orders. Corresponding to such a frame structure, a frame period Tf that is a frame transmission period is divided into q subframe periods Tsf, and each of which is assigned to each of the subframes SF. In addition, the subframe period Tsf is divided into a reset period TR for initialization, an address period TA for addressing and a display period TS for lighting. The length of the reset period TR and the length of the address period TA are constant regardless of the weight, while the length of the display period TS is longer as the weight is larger. Therefore, the length of the subframe period Tsf is also longer as the weight of the corresponding subframe SF is larger.

Figure 4:
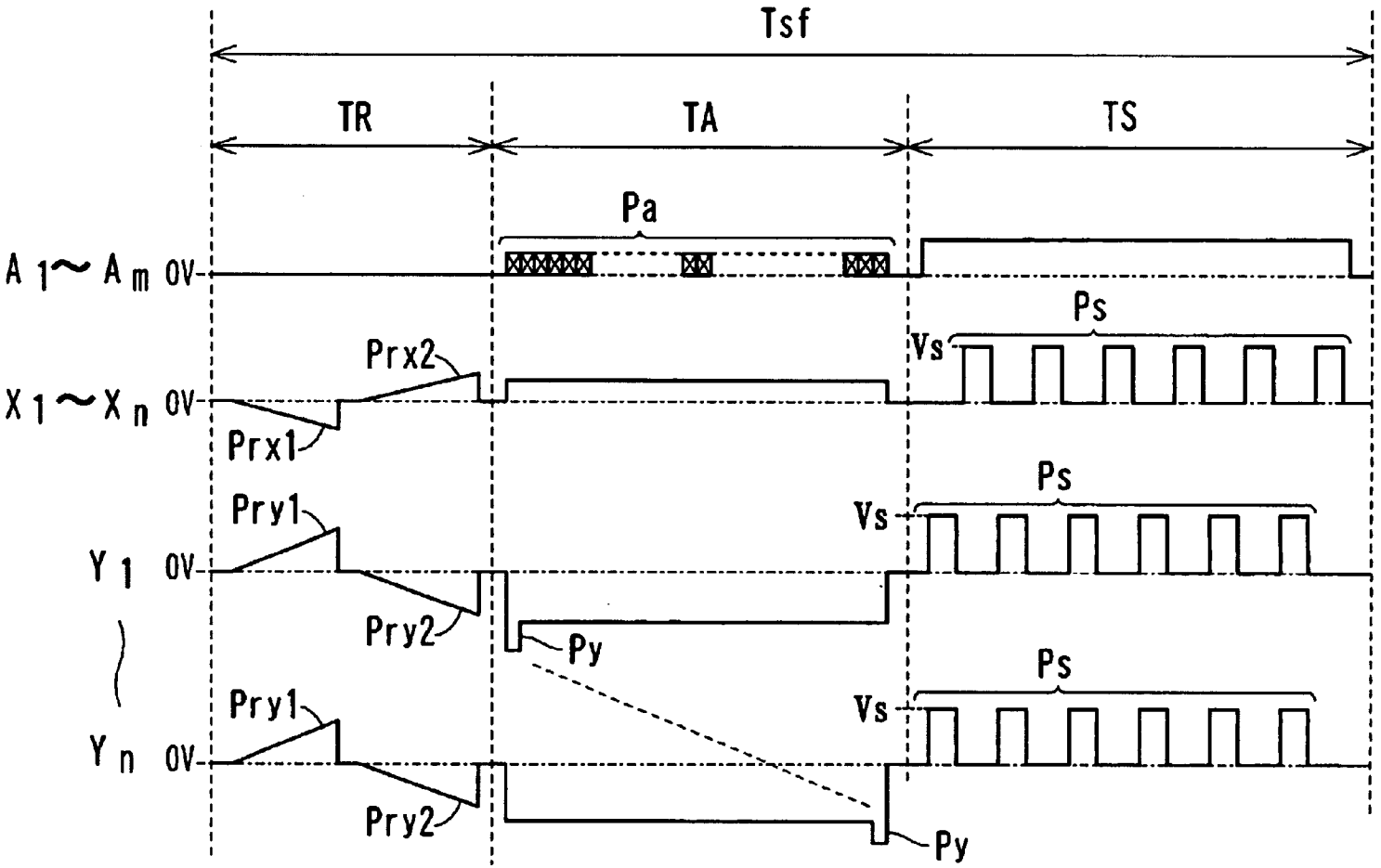
FIG. 4 shows voltage waveforms of a general driving sequence.

FIG. 4 shows voltage waveforms of a general driving sequence. In FIG. 4, the suffixes (1–n) of reference letters of the display electrodes X and Y denote the arrangement order of the corresponding row, while the suffixes (1–m) of the address electrode A shows the arrangement order of the corresponding column. The illustrated waveform is an example, and the amplitude, the polarity or the timing can be modified variously.

The order of the reset period TR, the address period TA and the display period TS is common to q subframes SF, and the driving sequence is repeated for each subframe. In the reset period TR of the subframe SF, a pulse Prx1 having the negative polarity and a pulse Prx2 having the positive polarity are applied to all the display electrodes X sequentially, while a pulse Pry1 having the positive polarity and a pulse Pry2 having the negative polarity are applied to all the display electrodes Y sequentially. The pulses Prx1, Prx2, Pry1 and Pry2 are ramp waveform pulses whose amplitude increases at a rate enabling microdischarge to be generated. The pulses Prx1 and Pry1 are applied first so as to generate an appropriate wall voltage having the same polarity in all cells regardless of being lighted or not in the previous subframe. By applying pulses Prx2 and Pry2 to cells having an appropriate wall charge, the wall voltage can be adjusted to the value corresponding to the difference between the discharge start voltage and the pulse amplitude. It is possible to apply the pulse only to one of the display electrodes X and Y for the initialization. However, by applying the pulses having the opposite polarities to each other to the display electrodes X and Y as shown in FIG. 4, a withstand voltage of the driver circuit element can be lowered. The driving voltage applied to the cell is a total voltage of amplitudes of pulses that are applied to the display electrodes X and Y.

In the address period TA, the wall charge necessary for sustaining is formed only in cells to be lighted. All the display electrodes X and all the display electrodes Y are biased to a predetermined potential, and a scan pulse Py having the negative polarity is applied to a display electrode Y corresponding to a selected row every row selection period (every scan time for a row). Concurrently with this row selection, an address pulse Pa is applied only to the address electrode A corresponding to the selected cell that should generate address discharge. In other words, potentials of the address electrodes $A_1$–$A_m$ are controlled in binary manner on the basis of the subframe data Dsf of selected m rows. In the selected cell, discharge is generated between the display electrode Y and the address electrode A, and the discharge causes surface discharge between the display electrodes. This sequential set of discharge is address discharge.

In the sustain period TS, a sustain pulse Ps having a predetermined polarity (e.g., the positive polarity in FIG. 4) is applied to all the display electrodes Y first. After that, the sustain pulse Ps is applied to the display electrode X and the display electrode Y alternately. The amplitude of the sustain pulse Ps is the sustaining voltage (Vs). When the sustain pulse Ps is applied, surface discharge is generated in cells in which predetermined wall charge remains. The number of times the sustain pulse Ps is applied corresponds to the weight of the subframe as explained above. In order to prevent undesired discharge during the sustain period TS, the address electrode A is biased to the same polarity as the sustain pulse Ps.

Among the above-mentioned driving sequence, the application of the ramp waveform pulse in the reset period TR is important for the present invention. Hereinafter, the reset circuit 65 of the Y-driver 64, which is means for applying the pulses Pry1 and Pry2, will be covered as a type, and the structure as well as the operation thereof will be explained. The structure of the reset circuit 62 of the X-driver 61, which is means for applying the pulses Prx1 and Prx2, is basically the same as that of the reset circuit 65 except the difference of the polarity.

Figure 5:
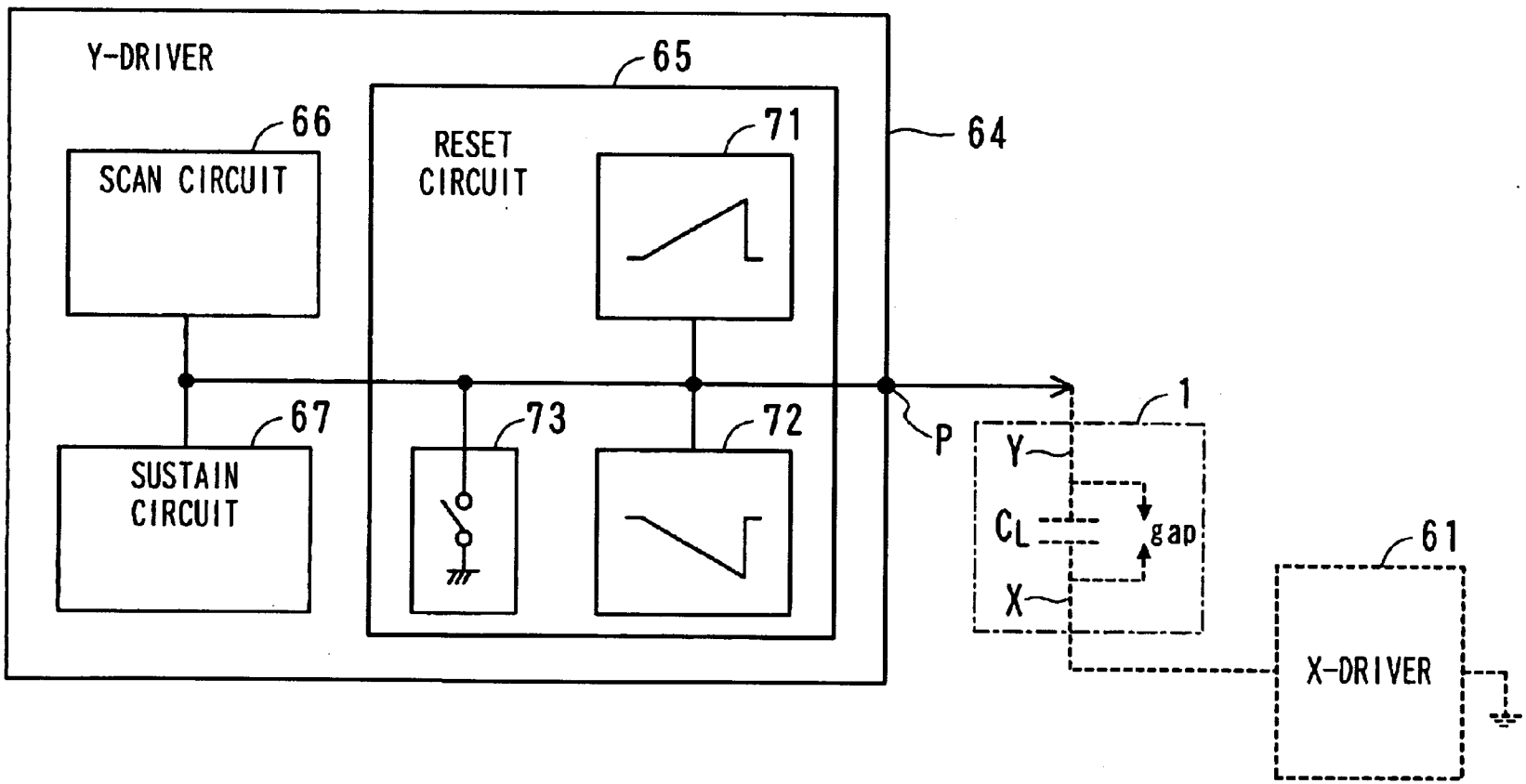
FIG. 5 is a block diagram of a reset circuit of a Y-driver.

FIG. 5 is a block diagram of the reset circuit of the Y-driver. The reset circuit 65 includes a positive voltage output block 71 for applying a pulse Pry1 to the PDP 1, a negative voltage output block 72 for applying a pulse Pry2 to the PDP 1 and a ground block 73 for connecting an output terminal P to the ground. The output terminal P is connected to the plural display electrodes Y, and each of the display electrodes X corresponding to each of the display electrodes Y is connected to the X-driver 61. When the display electrode Y is biased with respect to the ground potential, a voltage corresponding to the potential of the display electrode X is applied between the display electrodes. In the following explanation, the capacitance between the display electrodes is referred to as a load $C_L$. The output terminal P is also connected to the scan circuit 66 and the sustain circuit 67.

FIRST EXAMPLE

Figure 6:
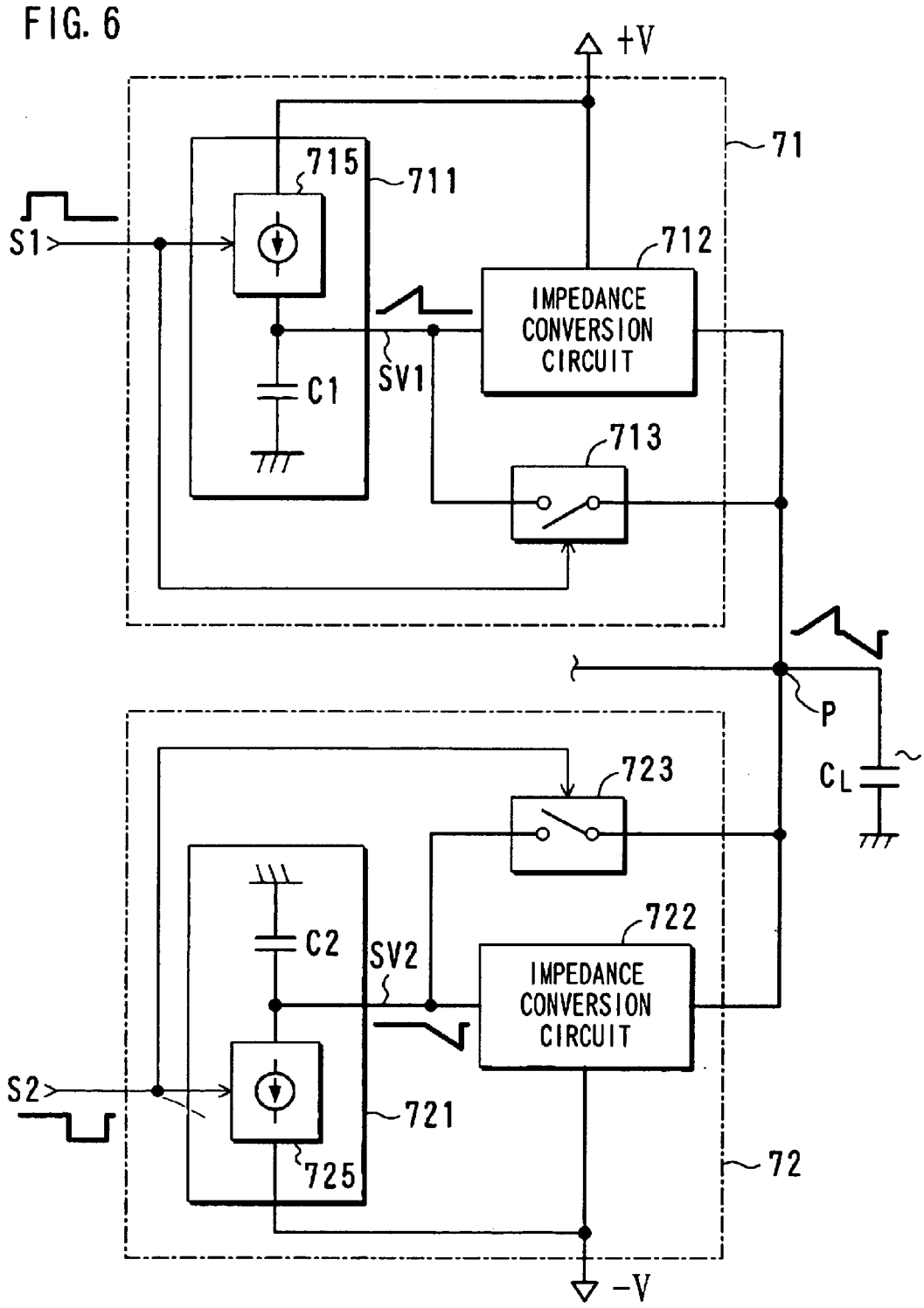
FIG. 6 is a functional block diagram of a voltage output block pair according to a first example.

FIG. 6 is a functional block diagram of a voltage output block pair according to a first example. The positive voltage output block 71 includes a waveform generation circuit 711 for outputting an increasing voltage signal SV1 when a control signal S1 is active, an impedance conversion circuit 712 for reducing an output impedance of the waveform generation circuit 711, and a switch circuit 713 for connecting the input terminal and the output terminal of the impedance conversion circuit 712 when the control signal S1 is not active. The waveform generation circuit 711 includes a capacitance element C1 and a constant-current source 715, so as to generate an increasing voltage waveform by supplying current to the capacitance element C1. In the same way, the negative voltage output block 72 includes a waveform generation circuit 721, an impedance conversion circuit 722 and a switch circuit 723. The waveform generation circuit 721 includes a capacitance element C2 and a constant-current source 725, so as to output an increasing voltage signal SV2 when a control signal S2 is active.

Figure 7:
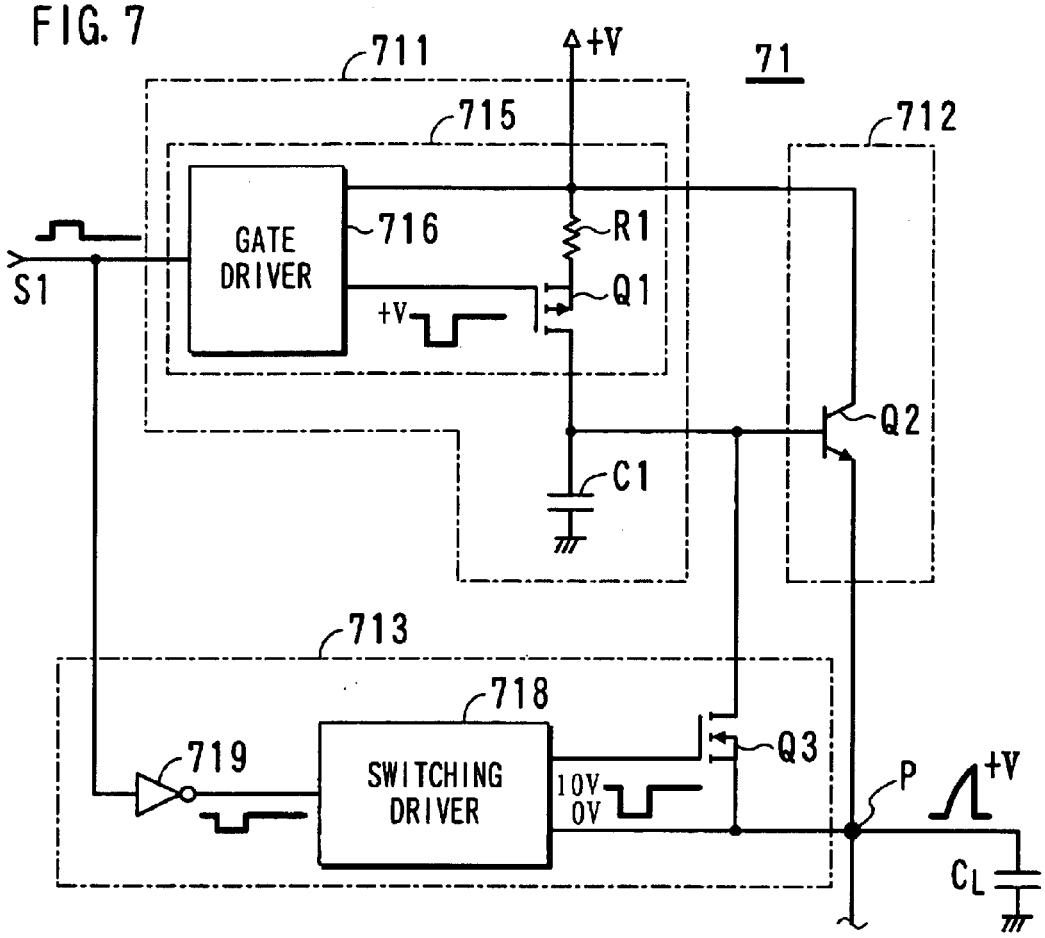
FIG. 7 is a schematic diagram of the first example of the positive voltage output block.
Figure 8:
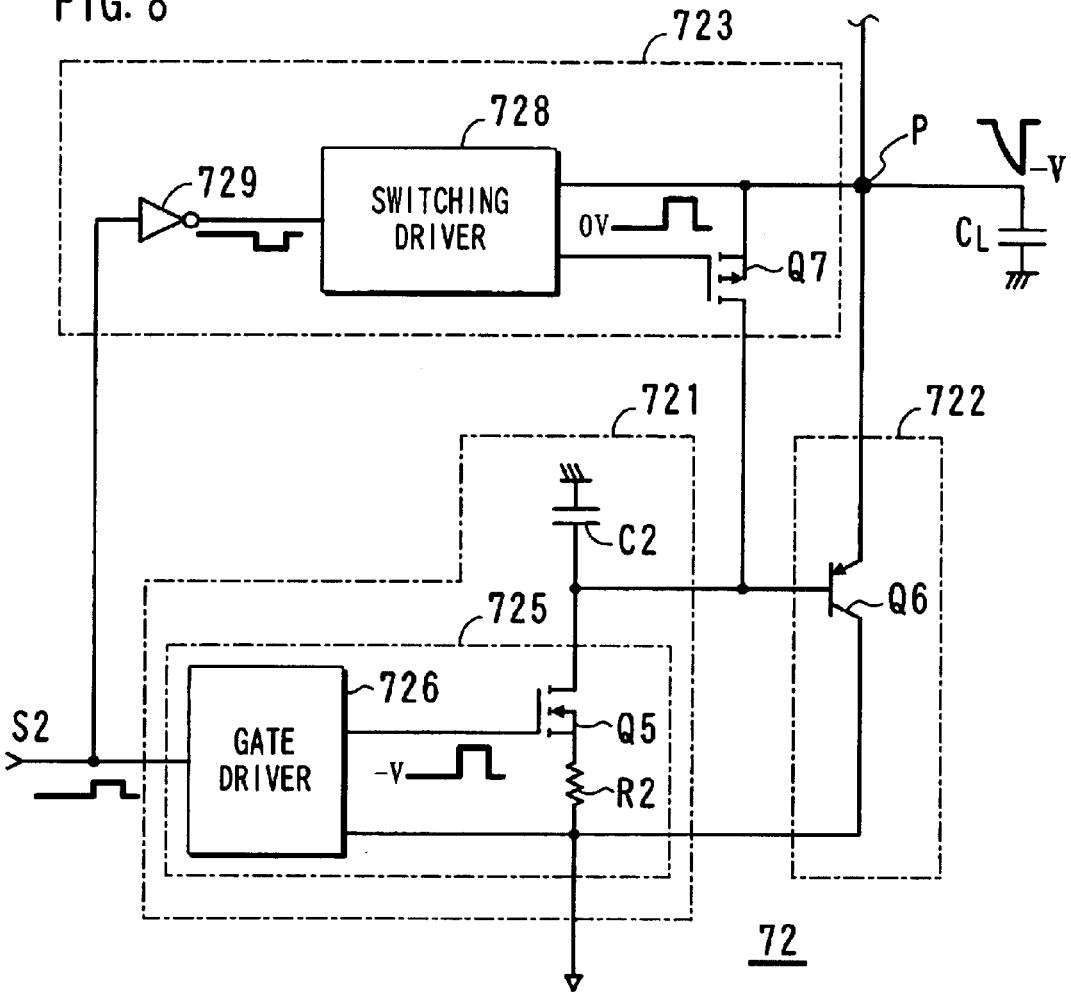
FIG. 8 is a schematic diagram of the first example of the negative voltage output block.

FIG. 7 is a schematic diagram of the first example of the positive voltage output block. FIG. 8 is a schematic diagram of the first example of the negative voltage output block. In the positive voltage output block 71, the constant-current source 715 of the waveform generation circuit 711 includes a P-channel MOS type field-effect transistor Q1, a source resistor R1 and a gate driver 716. The impedance conversion circuit 712 is an emitter follower circuit including an NPN type transistor Q2. The switch circuit 713 includes an N-channel MOS type field-effect transistor Q3, a switching driver 718 and an inverter 719. In the negative voltage output block 72, the constant-current source 725 of the waveform generation circuit 721 includes an N-channel MOS type field-effect transistor Q5, a source resistor R2 and a gate driver 726. The impedance conversion circuit 722 is an emitter follower circuit including a PNP type transistor Q6. The switch circuit 723 includes a P-channel MOS type field-effect transistor Q7, a switching driver 728 and an inverter 729. The positive voltage output block 71 and the negative voltage output block 72 are connected to each other at the output terminal P, so as to form a complementary symmetric circuit to the load CL.

Next, the circuit operation of the positive voltage output block 71 will be explained as a type.

When the control signal S1 is inputted, the gate driver 716 outputs a signal having the amplitude of −10 volts with respect to the power source potential +V to the gate of the transistor Q1. Simultaneously, the inverted signal of the control signal S1 is given to the switching driver 718, so that the driver output changes from 10 volts to 0 volts. As a result, the transistor Q3 is turned on, and the path between the input and the output of the impedance conversion circuit 712 is cut off. Supposing that the resistance of the source resistor R1 is r1, since the threshold voltage of the transistor Q1 is approximately 3 volts, the current I=(10−3)/r1 amperes flows through the drain of the transistor Q1. This current value is determined by the output voltage of the gate driver 716 and the source resistor R1, so the constant-current source 715 operates without affected by the state of the load that is connected to the drain of the transistor Q1. Since the switch circuit 713 is turned off at this time point, a constant-current I charges the capacitance element C1, and a ramp waveform having a constant gradient is generated at the node of the transistor Q1 and the capacitance element C1.

When the capacitance element C1 is charged by the constant-current I, the gradient dV/dt is I/c1 since I=dQ/dt=c1dV/dt, where c1 is a capacitance. More specifically, supposing r1=700 ohms, c1=0.01 microfarads, since I=0.01 amperes, a ramp waveform having the gradient of dV/dt=1 volts per microsecond is generated. It is desirable to use a capacitance element C1 such as a laminated film capacitor that has a withstand voltage more than +V and does not have a piezoelectric effect. If a ceramic capacitor is used, its piezoelectric effect changes the capacitance in accordance with the applied voltage, so that gradient is changed when the power source potential +V varies. In contrast, if an element without the piezoelectric effect is used, the gradient is not changed even if the power source potential +V is changed, so that the adjustment can be omitted.

The generated ramp waveform is given to the base of the transistor Q2 in the impedance conversion circuit 712, and the ramp waveform is outputted from the emitter to the load $C_L$ after being amplified in current. The output impedance of the transistor Q2 whose collector is connected to the ground is $1/h_{FE}$ of the input impedance, e.g., approximately 1/100.

When the control signal S1 becomes non-active after e.g., 200 microseconds passed from the input of the control signal S1, the constant-current source 715 is turned off while the transistor Q3 is turned on, so that the base and the emitter of the transistor Q2 are connected. Approximately 500–1 nanoseconds after this time point, the ground circuit 73 (see FIG. 5) works, so that the output terminal P is forced to be cramped to the ground potential, and the charge stored in the load $C_L$ is absorbed by the ground circuit 73. In addition, the charge stored in the capacitance element C1 is absorbed by the ground circuit 73 via the transistor Q3.

In the above-explained operation, the ramp waveform output is obtained. However in this example, because of an influence of the base current of the transistor Q2, the output waveform does not become a line with a constant gradient, but an exponential waveform with a curved portion. This curve to some extent does not affect the practical use.

The emitter follower adopted as the impedance conversion circuit 712 has a feature of being always active even if there is no input signal, and the output is connected to the ground line with a low AC impedance. In other words, the output terminal P is regarded as being connected to the ground line via a capacitor having an infinite capacitance. In this example, during the period while the ramp waveform is not outputted, the input and the output of the impedance conversion circuit 712 are connected with each other via the switch circuit 713, so that the transistor Q2 is turned off completely. Therefore, the impedance conversion circuit 712 can be seen as having a minute capacitance approximately 100 picofarads from the output terminal P. The load viewed from the output terminal P is only the capacitance element C1 that can be seen via the transistor Q3. A capacitance c1 has a relationship with current of constant-current source but can be set to any value to some extent. Therefore, if the capacitance c1 is set to a value sufficiently smaller than the load $C_L$, the influence on the scan circuit 66 or the sustain circuit 67 can be eliminated. The transistor Q1 must have a withstand voltage higher than a difference between the positive power source potential +V and the negative power source potential −V, while it is sufficient if the transistor Q1 has the current capacity of approximately 100 milliamperes. Therefore, "2SJ181" can be used as the transistor Q1, for example. The transistor Q2 must have the current capacity of at least a few hundred milliamperes and the same withstand voltage as the transistor Q1 has. As the transistor Q2, "2SC3840" can be used, for example. Though a voltage higher than a few volts is not applied to the transistor Q3, it must withstand a peak current of a few amperes that is generated when the ground circuit 73 extracts the charge of the load $C_L$ rapidly. It is preferable to use "2SK2231" as the transistor Q3.

The above explanation is about the operation of the positive polarity side for making the explanation easy. The negative voltage output block 72 works in the same way as the positive voltage output block 71 except the difference of the polarity. As a concrete example of models, "2SK1152" can be used as the transistor Q5, "2SA1486" can be used as the transistor Q6 and "2SJ377" can be used as the transistor Q7.

In the first example, bipolar transistors can be used for the constant-current sources 715 and 725 instead of the MOS type field-effect transistors. In this case, the constant-current $I=(10-V_{BE})/r1=(10-0.7)/r1$ amperes. Bipolar transistors can be used as switching elements for the switch circuits 713 and 723, too. There is another variation in which a current limiting resistor is inserted between the base of the transistor Q2 or Q6 of the impedance conversion circuit 712 or 722 and the waveform generation circuit 711 or 721 so as to optimize the operation. In addition, instead of the structure in which the control signals S1 and S2 are inverted before being imparted to the switching drivers 718 and 728, another switching control signal that is a little different from the control signals S1 and S2 in timing can be supplied to optimize the entire circuit operation.

Hereinafter, other examples will be explained. In the drawings of the other examples, the same elements as in the above-mentioned first example are illustrated with simplification and by the same references.

SECOND EXAMPLE

Figure 9:
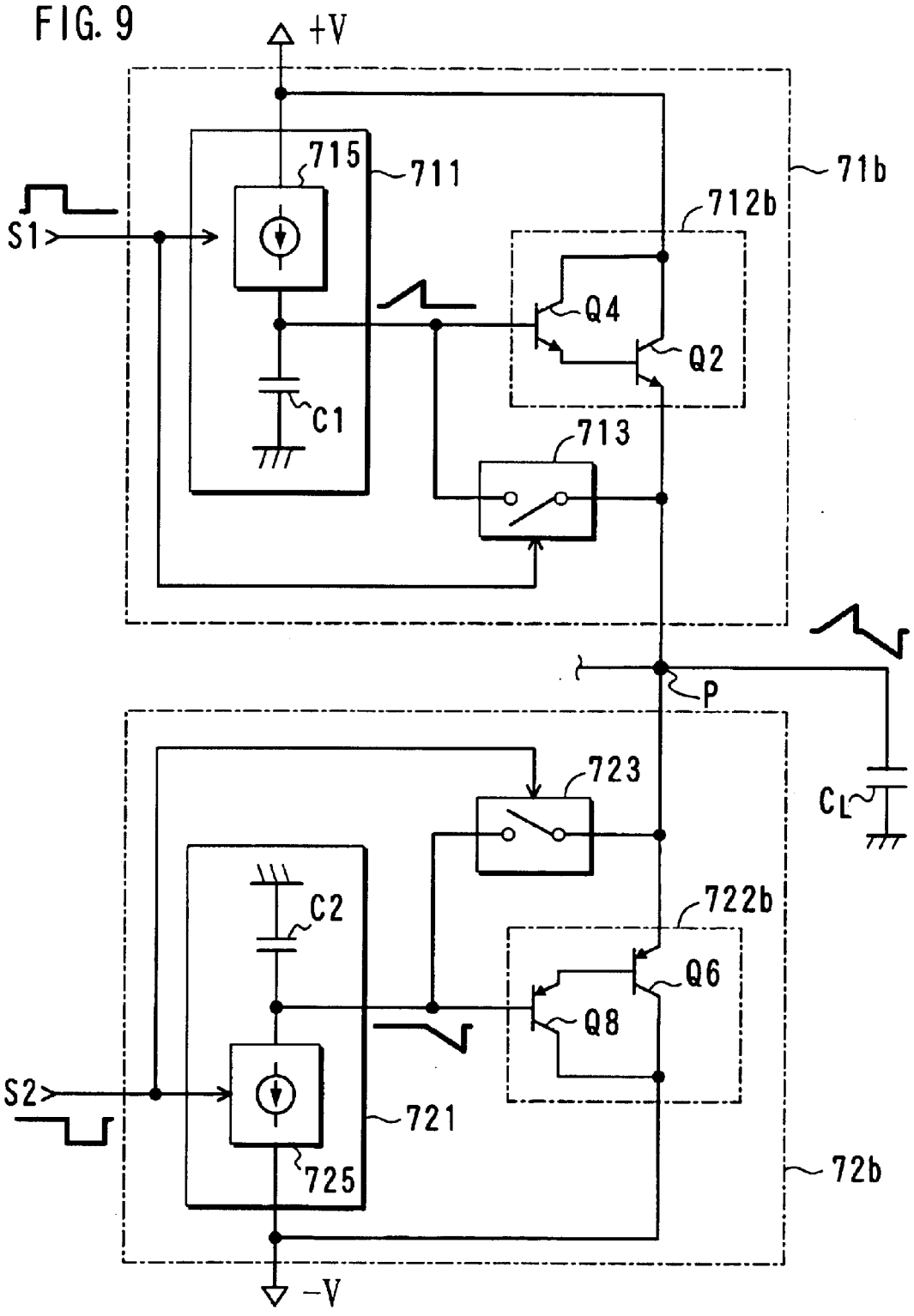
FIG. 9 is a schematic diagram of a voltage output block pair according to a second example.

FIG. 9 is a schematic diagram of a voltage output block pair according to a second example. The second example of the positive voltage output block 71*b* and the negative voltage output block 72*b* has a feature that the impedance conversion circuits 712*b* and 722*b* include plural transistors in Darlington connection.

The above-mentioned first example has a sufficient capacity for a driving circuit of a small size panel having a small load $C_L$ whose total sum of current value due to microdischarge and the ramp waveform is less than a few ten milliamperes. However, there is a problem when driving a large size PDP of 42 inches or more whose total sum of current reaches a few hundred milliamperes. Namely, as the current increases, a variation of the gradient with respect to the output current increases. This phenomenon is caused by a base current of the impedance conversion circuit. Supposing that the output current of the impedance conversion circuit is Ic, the current of $Ib=Ic/h_{FE}$ ("$h_{FE}$" is a current amplification) flows through the base. In the first example, since the $h_{FE}$ is approximately 100, the base current flowing into the impedance conversion circuit is 0.5 milliamperes when the output current is 50 milliamperes. On the other hand, the constant-current sources 715 and 725 are generating current I=10 milliamperes when r1=700 ohms. In the explanation of the first example, it was assumed that the whole current charges the capacitance element C1 for calculation. However, the real charging current is I−Ib, and the current of 9.5 milliamperes actually charges the capacitance element C1 in the example. Therefore, in order to make the charging current 10 milliamperes, the current of the constant-current sources 715 and 725 should be 10.5 milliamperes. Accordingly, the resistance r1 of the source resistor R1 should be 667 ohms. For driving a large size PDP in which the output current of the impedance conversion circuits 712*b* and 722*b* becomes 500 milliamperes, the base current becomes 5 milliamperes that is a half of the current of the constant-current sources 715 and 725, and the charging current of the capacitance element C1 decreases to 5 milliamperes. Even if the value of r1 is changed so as to flow the current of 15 milliamperes, the output current becomes 250 milliamperes when the microdischarge is not generated. Therefore, the base current becomes 25 milliamperes, and only the current of 12.5 milliamperes charges the capacitance element C1. Namely, if the value of the base current cannot be neglected compared with the charging current of the capacitance element C1, the charging current of the capacitance element C1 varies in accordance with the variation of the output current, though it is important for generating a ramp waveform having a constant gradient. In order to solve this problem, the Darlington connection is utilized in the second example.

It is known that the current amplification of the Darlington connection is the product of the current amplifications of the transistors. For example, if 2SC4002 is used for the transistor Q4 of the impedance circuit 712*b* and 2SC3840 is used for the transistor Q2, the total current amplification is 100×100=10000 since each $h_{FE}$ of the transistors Q4 and Q2 is approximately 100. Therefore, the base current becomes 0.05 milliamperes when the output current is 500 milliamperes, while it is 0.025 milliamperes when the output current is 250 milliamperes. A variation of the base current depending on the microdischarge is 0.25% of the charging current of the capacitance element C1 that is 10 milliamperes, so the variation can be neglected. The Darlington connection is not limited to two stages but can be three or four stages in accordance with the necessity.

The effect of the Darlington connection of the transistors Q8 and Q6 of the impedance conversion circuit 722*b* in the negative polarity side is similar to that of the impedance conversion circuit 712*b* in the positive polarity side. 2SA1699 can be used as the transistor Q8, and 2SA1486 can be used as the transistor Q6.

According to the second example, the influence of the input current of the impedance conversion circuit is reduced compared with the first example, so that a ramp waveform output whose gradient is more linear can be obtained.

THIRD EXAMPLE

Figure 10:
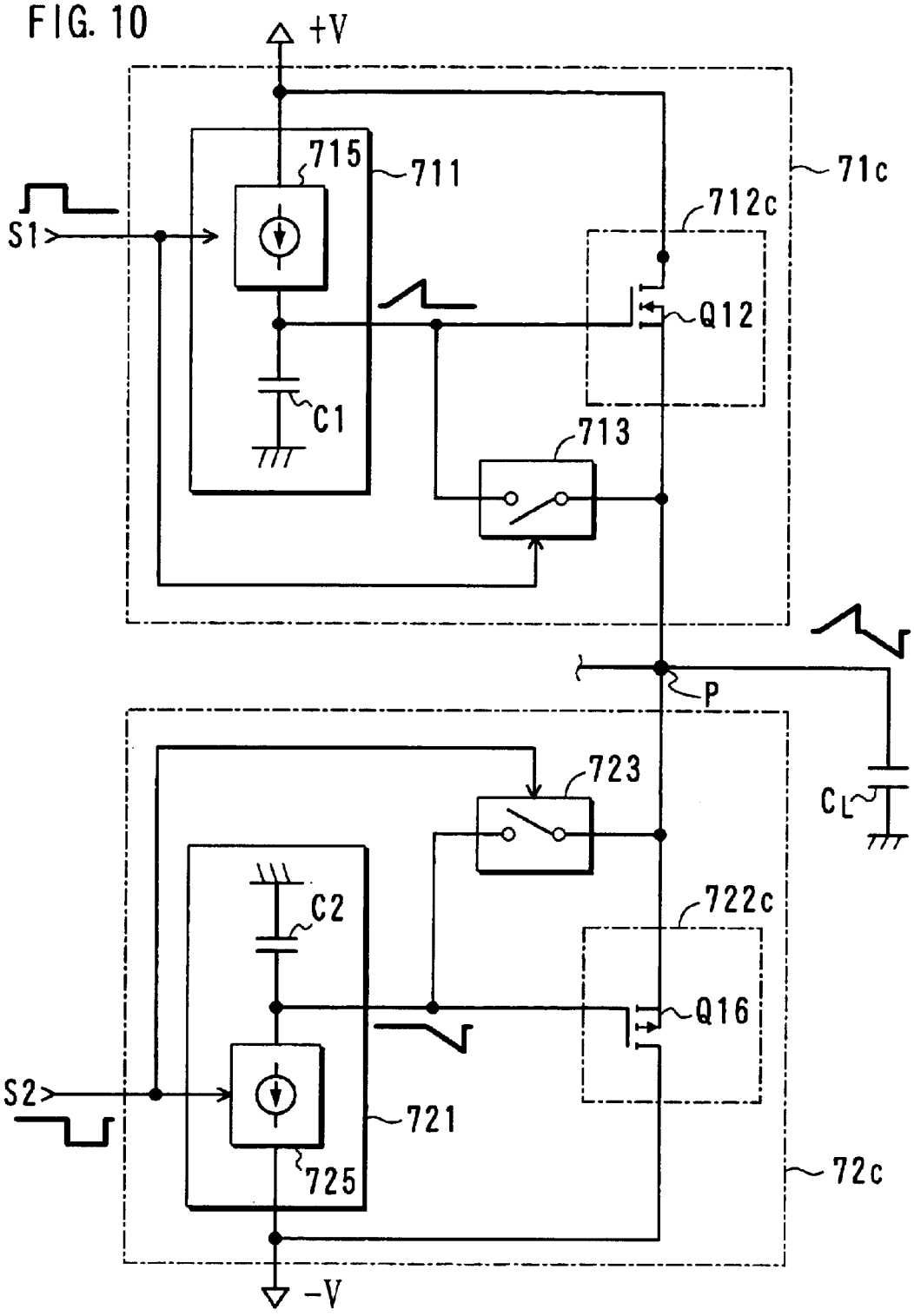
FIG. 10 is a schematic diagram of a voltage output block pair according to a third example.

FIG. 10 is a schematic diagram of a voltage output block pair according to a third example. In the third example, the positive voltage output block 71*c* and the negative voltage output block 72*c* have a feature that the impedance conversion circuits 712*c* and 722*c* include field-effect transistors Q12 and Q16 constituting a source follower. The problem of blunting the waveform in the first example is caused by the base current of the bipolar transistor. When the field-effect transistors Q12 and Q16, which are voltage control elements, are used for making the impedance conversion circuits 712*c* and 722*c*, the problem caused by the base current can be solved.

In the third example, a ramp waveform generated by charging the capacitance element C1 is supplied to the gate of the transistors Q12 and Q16. A ramp waveform output having a low impedance can be generated at the sources of the transistors Q12 and Q16 in drain connection. Differently from the first example and the second example, there is no current flowing from the waveform generation circuits 711 and 721 to the impedance conversion circuits 712*c* and 722*c*. Therefore, a Q factor of the capacitance element C1 becomes very large, and the amplitude of the ramp waveform increases linearly based on theory. Since a value of the output current does not affect the input side at all, a ramp waveform having a constant gradient can be supplied to the PDP 1 regardless of the output current. 2SK2045 and 2SJ459 can be used as the transistors Q12 and Q16. Without limiting to such MOS-FETs, other types of voltage control element such as an insulated gate bipolar transistor (IGBT) or a junction type FET can be used. It is also possible to insert a resistor in the gate circuit for suppressing an undesired oscillation.

FOURTH EXAMPLE

Figure 11:
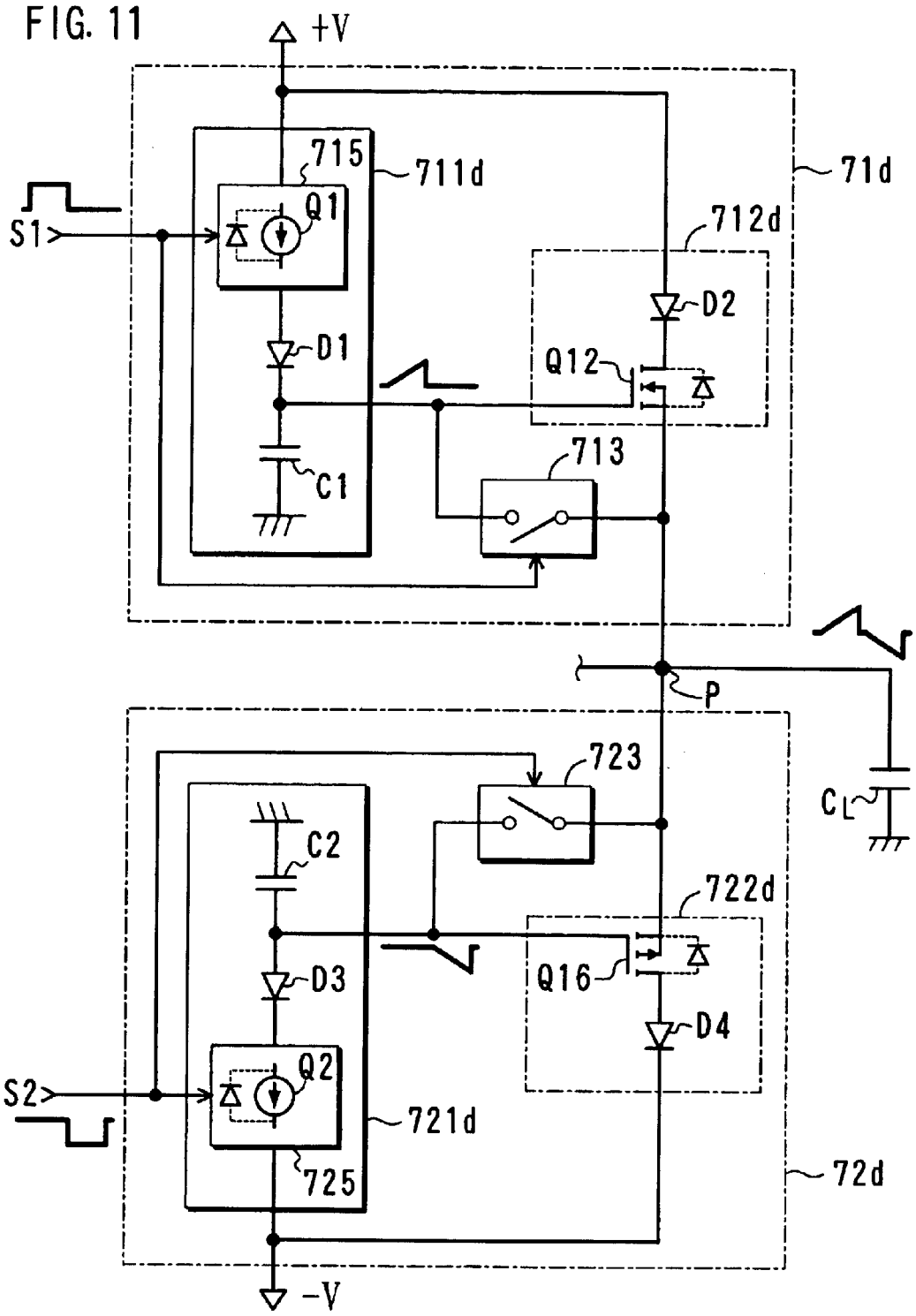
FIG. 11 is a schematic diagram of a voltage output block pair according to a fourth example.

FIG. 11 is a schematic diagram of a voltage output block pair according to a fourth example. The fourth example of the positive voltage output block 71*d* and the negative voltage output block 72*d* has a feature that the waveform generation circuits 711*d* and 721*d* as well as the impedance conversion circuits 712*d* and 722*d* include diodes D1, D2, D3 and D4 for preventing a short circuit to the power source.

In the above-mentioned three examples, it is a precondition that the power source voltages +V and −V for generating ramp waveforms are higher than the power source voltage of other driving circuits including the sustain circuit 67 and the scan circuit 66. However, the power source voltage of other driving circuits can be higher depending on the panel structure or the driving circuit structure. This example can deal with this condition.

As shown by the broken line in FIG. 11, a parasitic diode is connected between the drain and the source of each of the transistors Q1, Q2, Q12 and Q16 in the opposite direction to the polarity of the element without exception. This is due to the structure of a MOS-FET. Supposing that the potential of the output terminal P becomes higher than the power source potential +V when diodes D1 and D2 do not exist in the positive voltage output block 71*d*, the output terminal P is connected to the power source via the path including P, Q3 and Q1 and via the path including P and Q12. The diodes D1 and D2 cut off the paths so as to prevent the short circuit to the power source. When the normal ramp waveform is generated, the diodes D1 and D2 are biased in the forward direction. Therefore, the circuit operation is not affected at all though there is a voltage drop of approximately 0.7 volts. The diodes D1 and D2 must have a withstand voltage of Vm−(+V) volts when Vm is the maximum potential of the output terminal P. The diode D1 must have a current capacity more than 100 milliamperes, while the diode D2 must have a current capacity more than a few hundred milliamperes. It is the same concerning the negative polarity side block. 1NZ61 can be used as the diodes D1 and D3, and G16S can be used as the diodes D2 and D4.

FIFTH EXAMPLE

Figure 12:
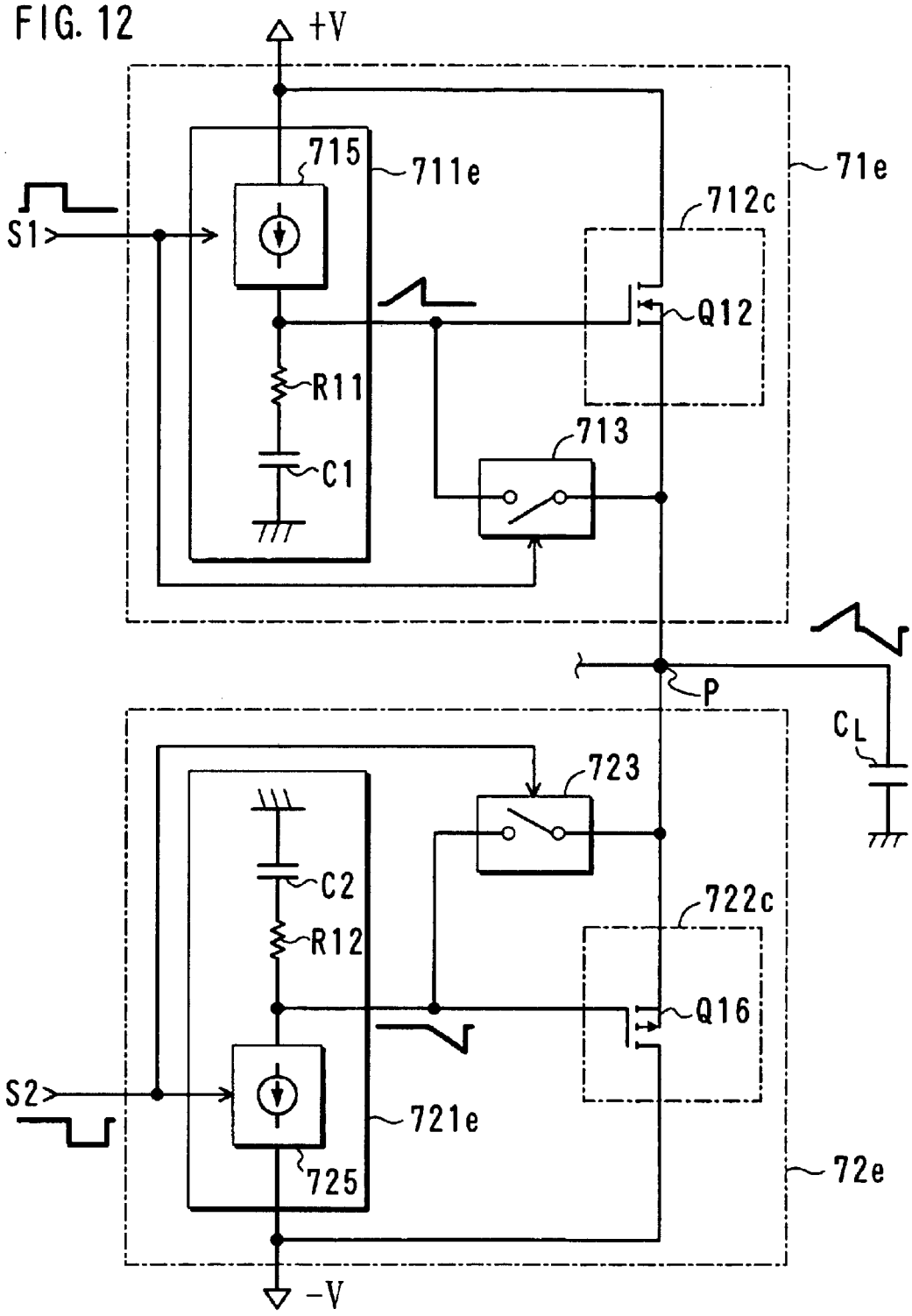
FIG. 12 is a schematic diagram of a voltage output block pair according to a fifth example.

FIG. 12 a schematic diagram of a voltage output block pair according to a fifth example. In the fifth example, the positive voltage output block 71*e* and the negative voltage output block 72*e* have a feature that the waveform generation circuits 711*e* and 721*e* include current limiting resistors R11 and R12.

In the positive voltage output block 71*e*, when the control signal S1 changes to non-active, the ground circuit works so that the charge of the capacitance element C1 is absorbed by the ground circuit via the switch circuit 713 and the output terminal P. The peak value of this current is restricted by the resistor R11. Supposing that the capacitance element C1 is directly connected to the switch circuit 713 (the transistor Q3) without resistor R11, the waveform of the current flowing through the switch circuit 713 in connection to the ground becomes an impulse waveform having the peak value of 7 amperes and the width of approximately 200 nanoseconds. If the resistor R11 of e.g., 100 ohms is inserted between the constant-current source 715 and the capacitance element C1 as shown in FIG. 12, the waveform of the current flowing through the switch circuit 713 in connection to the ground becomes a normal distribution waveform having the peak value of 1.8 amperes and the width of approximately 800 nanoseconds. If a resistance of the resistor R11 is less than a few kilohms that is sufficiently smaller than the input impedance of the impedance conversion circuit 722*c*, the resistor R11 does not affect charging of the capacitance element C1 at all. In this way, by connecting the current limiting resistor R11, the peak current when the capacitance element C1 discharges can be restricted, so that the flexibility of selecting a semiconductor element used for the switch circuit 713 can be enhanced. It is the same concerning the negative polarity side.

SIXTH EXAMPLE

Figure 13:
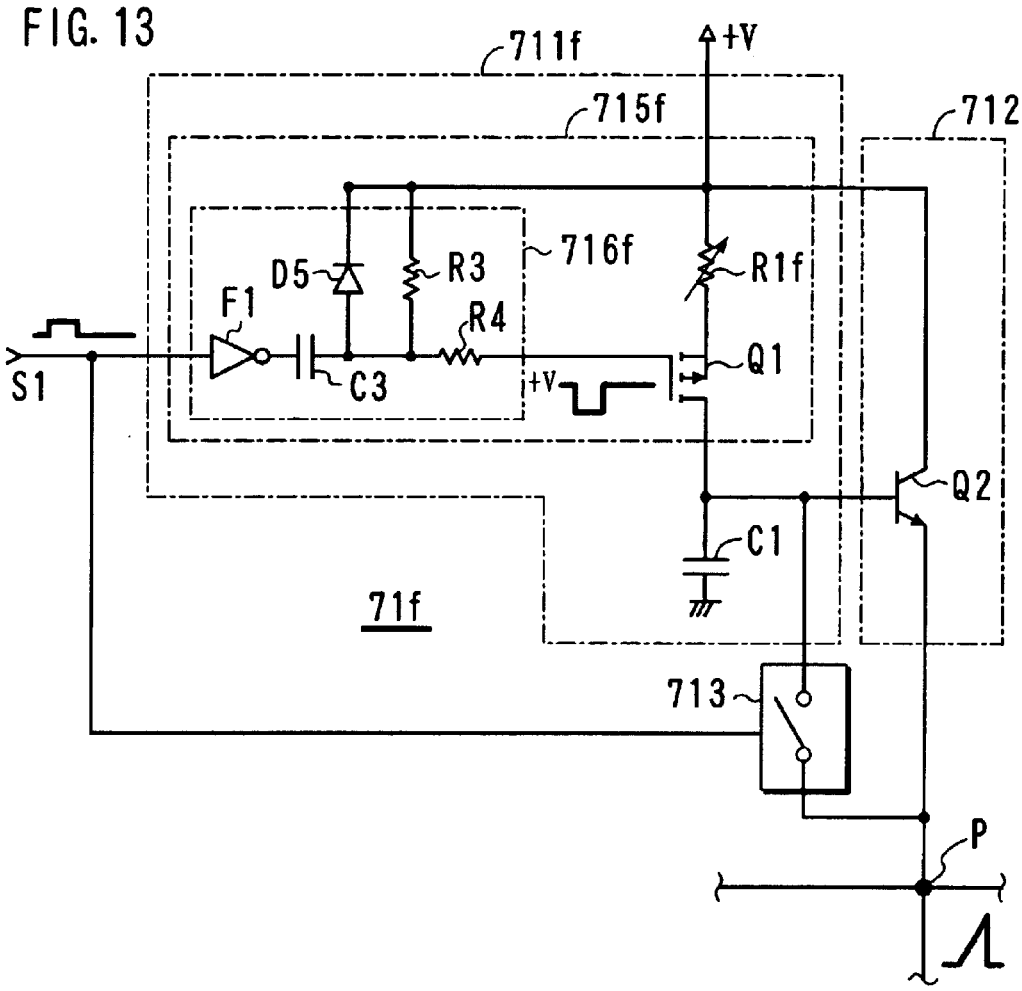
FIG. 13 is a schematic diagram of a positive voltage output block according to a sixth example.
Figure 14:
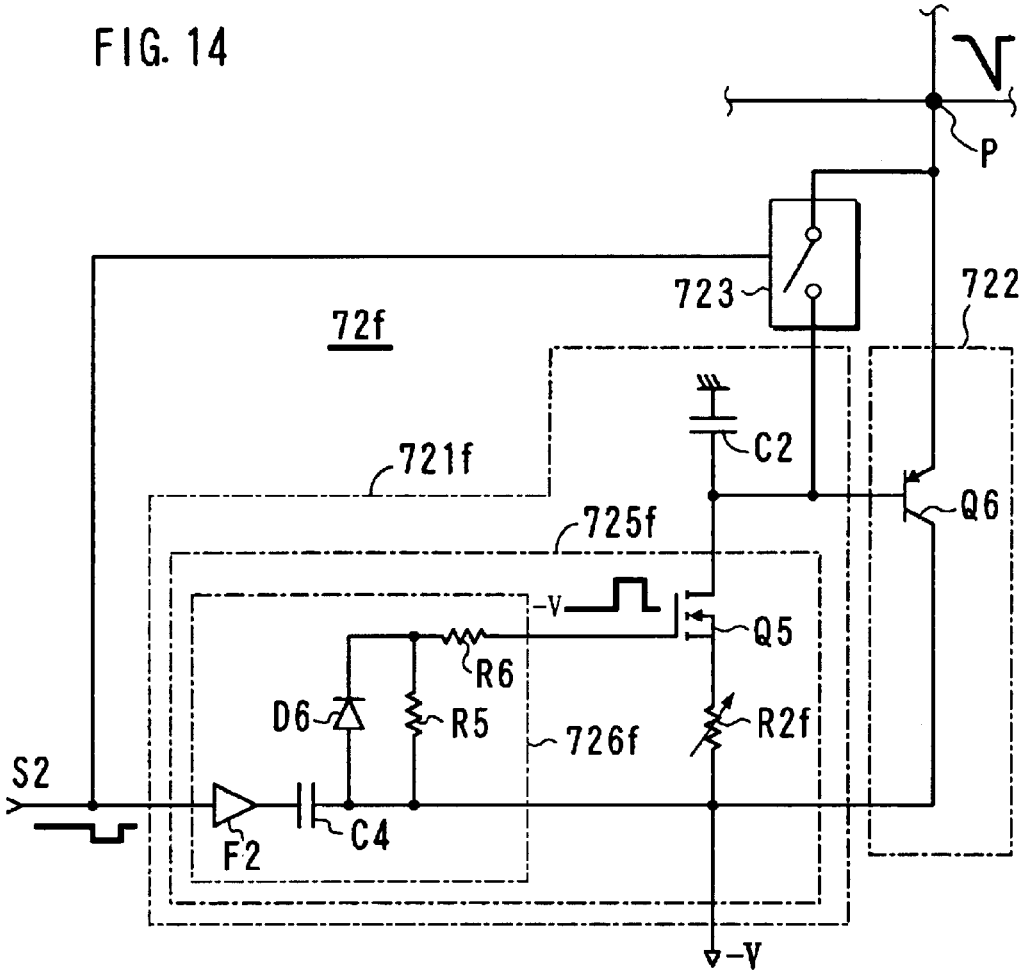
FIG. 14 is a schematic diagram of the negative voltage output block according to the sixth example.

FIG. 13 is a schematic diagram of a positive voltage output block according to a sixth example. FIG. 14 is a schematic diagram of the negative voltage output block according to the sixth example. In the sixth example, the positive voltage output block 71*f* and the negative voltage output block 72*f* have a feature that the constant-current sources 715*f* and 725*f* of the waveform generation circuits 711*f* and 721*f* include gate drivers 716*f* and 726*f* without a floating power source and include variable resistors R1*f* and R2*f*.

Figure 16:
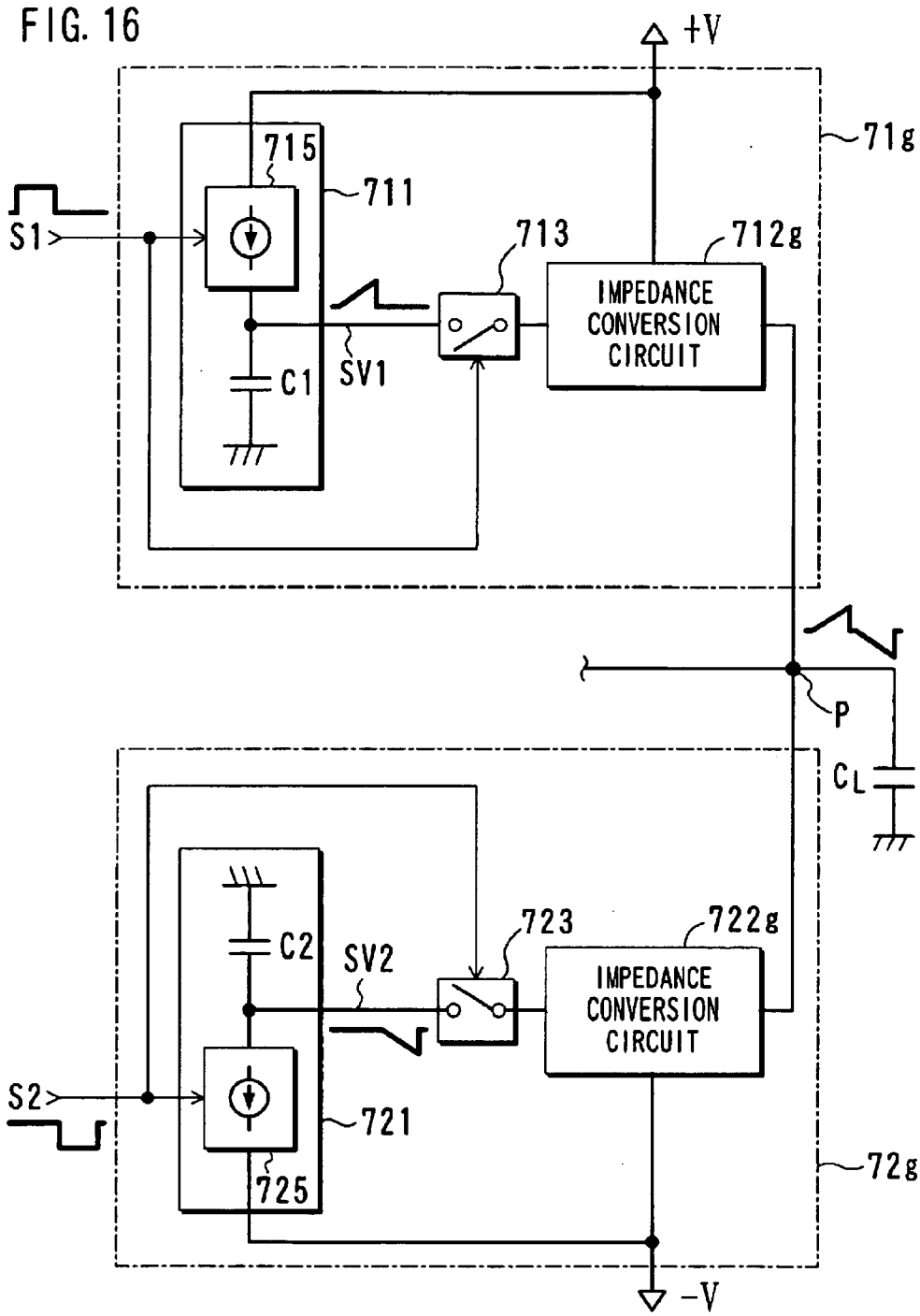
FIG. 16 is a functional block diagram of a voltage output block pair according to a seventh example.

Each of the gate drivers 912 and 922 shown in FIG. 16 receives the control signal S10 or S20 by a photocoupler and outputs a signal with the amplitude of approximately 10 volts that is isolated from the input signal concerning a potential. In this structure, floating power sources of +12 volts and −12 volts isolated from the ground line are necessary at the output side of the photocoupler. However, there is a desire not to use the floating power source for reducing a cost of the circuit. This example is aimed to satisfy the desire.

The gate driver 716*f* of the positive polarity side includes a pulse amplifier F1 for inverting and amplifying the control signal Si with a logic level to the amplitude of approximately 10 volts, a coupling capacitor C3 for separating potentials, a clamp diode D5, a clamp resistor R3 and a gate resistor R4. In the same way, the gate driver 716*f* of the negative polarity side includes a pulse amplifier F2, a coupling capacitor C4, a clamp diode D6, a clamp resistor R5 and a gate resistor R6. In the constant-current sources 715*f* and 725*f*, the source resistors Rif and R2*f* for determining the output current value can be fixed but are variable resistors in this example so that the current can be set at any value.

The circuit operation of the positive polarity side will be explained as a type. The control signal Si amplified by the pulse amplifier F1 is applied to the gate of the transistor Qi via the coupling capacitor C3. The coupling capacitor C3, the diode D5 and the resistor R3 constitute a clamp circuit having a time constant C3×R3. If the time constant is sufficiently larger than the pulse width of the input control signal, the output signal of the pulse amplifier F1 becomes a pulse signal that drops to +V−10 volts with respect to the power source potential +V. The gate resistor R4 is an element having the resistance of a few ten ohms for stabilizing the operation and does not affect the amplitude of the pulse signal. For example, when a capacitance of the coupling capacitor C3 is 0.1 microfarads and a resistance of R3 is 220 kilohms, the time constant becomes 22 milliseconds. As a result, a drop of the amplitude (a sag) in a flat portion of the pulse is restricted less than 1% even if the pulse width of the control signal is 200 microseconds. The IC TC4425 can be used for the pulse amplifier F1, and 1S1588 (a small signal diode) can be used as the diode D5.

Supposing that a resistance of the source resistor R1*f* is r1*f*, the current I=(10−3)/r1*f* amperes flows through the drain of the transistor Q1 since the threshold level voltage of the transistor Q1 is approximately 3 volts. Therefore, if the resistance r1*f* is variable, the drain current of the transistor Q1 can be set freely.

The components and the operation at the negative polarity side shown in FIG. 14 are the same as those at the positive polarity side except that the pulse amplifier F2 of the gate driver 726 is a non-inverting amplifier. TC4425 as the pulse amplifier F1 includes an inverting amplifier and a non-inverting amplifier, so the remaining half can be used for the pulse amplifier F2.

Figure 15:
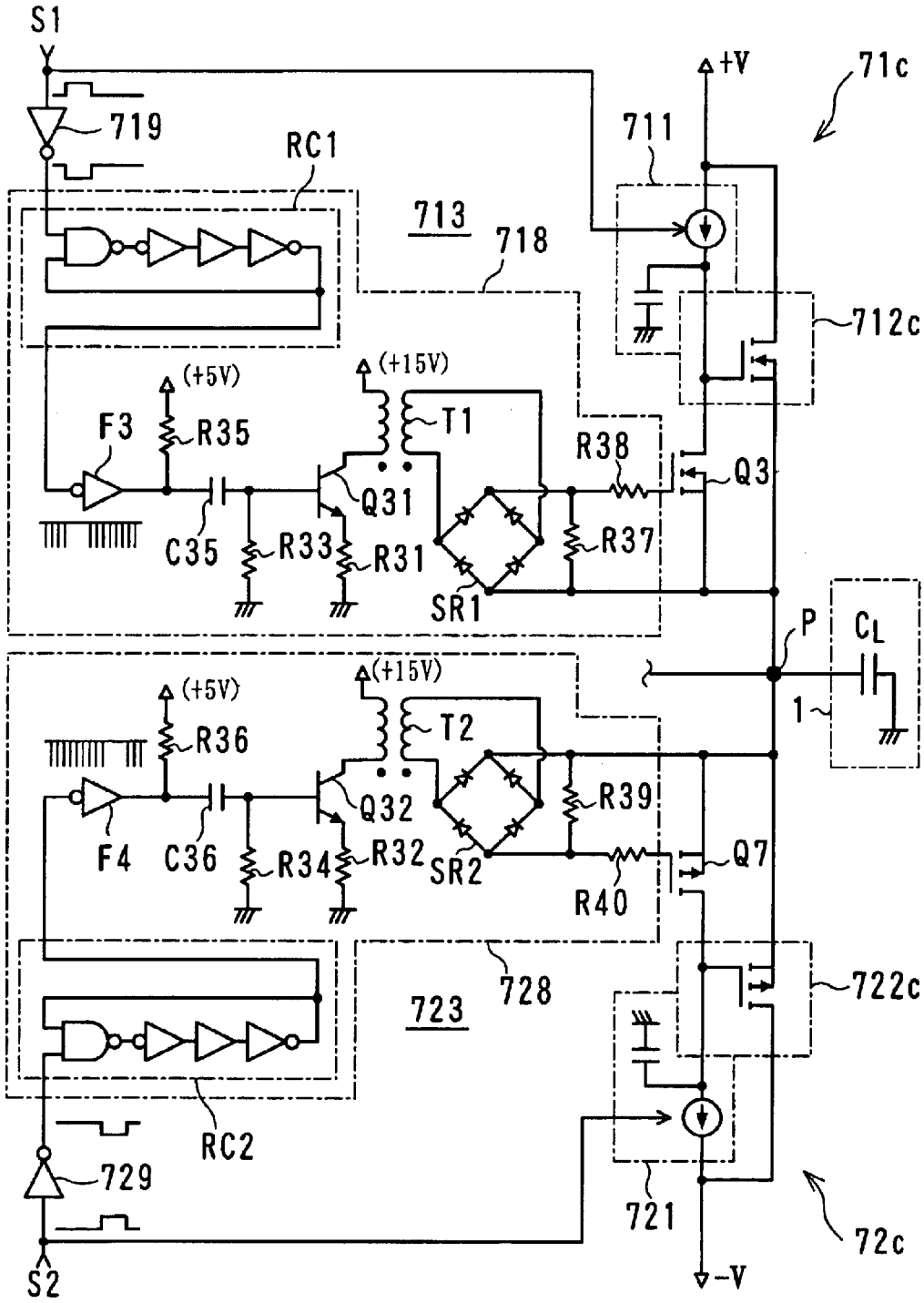
FIG. 15 is a schematic diagram showing an example of a switching driver.

FIG. 15 is a schematic diagram showing an example of the switching driver. Though the third example is illustrated as a structure of the power output pair, the switching driver having the following structure can be used for other examples, too.

The switching driver 718 of the switch circuit 713 at the positive polarity side includes a ring counter RC1, an inverter F3, a transistor Q31, a pulse transformer T1 and a rectifying circuit SR1. In the same manner, the switching driver 728 of the switch circuit 723 at the negative polarity side also includes a ring counter RC2, an inverter F4, a transistor Q32, a pulse transformer T2 and a rectifying circuit SR2. The switching drivers 718 and 728 realize on and off control of the transistors Q3 and Q7 connected to the output terminal P having unfixed potential without a floating power source.

The switching driver 718 at the positive polarity side and the switching driver 728 at the negative polarity side work similarly to each other except that the diodes of the rectifying circuits SR1 and SR2 have the polarities opposite to each other. In the switching drivers 718 and 728, the ring counters RC1 and RC2 are made of delay elements (e.g., 74LS31) and generate a carrier pulse having the width of approximately 100 nanoseconds and the frequency of approximately 5 MHz as long as the enable terminal is the high level. When the control signals S1 and S2 are inputted to the inverters 719 and 729 (e.g., 74LS04), the enable terminals of the ring counters RC1 and RC2 become the low level, and the ring counters RC1 and RC2 stop the generation of the carrier pulse. When the control signals S1 and S2 become non-active, the ring counters RC1 and RC2 start to generate the carrier pulse again. Thus, a carrier signal modulated by the control signals S1 and S2 is obtained. The carrier signal is inverted by the inverters F3 and F4 and then is applied to the bases of the transistors Q31 and Q32 so as to drive primary sides of the pulse transformers T1 and T2 connected to the collector sides. The resistors R31 and R32 connected to the emitter sides of the transistors Q31 and Q32 are feedback resistors for stabilizing the operations of the transistors Q31 and Q32. The pulse transformers T1 and T2 are transformers of 1:1 in which a pair of wires having the diameter of 0.4 millimeters is winded approximately ten turns on a toroidal core, for example. At the secondary side of the transformers, the carrier signal having the amplitude of approximately 12 volts with respect to 15 volts appears. The carrier signal is rectified in full wave by the rectifying circuit SR1 or SR2 including a diode bridge and is smoothed with a time constant determined by a capacitance between the gate and the source of the transistor Q3 or Q7 (approximately 1000 picofarads) and the resistor R38 or R40 and becomes a switching signal having the amplitude of approximately 10 volts. The transistor Q3 is turned off only during the period while the control signal S1 is inputted, while the transistor Q7 is turned off only during the period while the control signal S2 is inputted. The resistors R37 and R39 are gate resistors for turning off the transistors Q3 and Q7 securely by extracting the gate charge of the transistors Q3 and Q7. The resistors R33 and R34 are bias resistors of the transistors Q31 and Q32. The resistors R35 and R36 are pull up resistors for lifting up the high level output of the inverters F3 and F4 to 5 volts. The capacitors C35 and C36 are coupling capacitors for preventing a direct current from flowing into the transistors Q31 and Q32. It is preferable to use 2SC2720 as the transistors Q31 and Q32 since a pulse current having a value more than 100 milliamperes flows through the collector and withstand voltage more than 30 volts is required. It is desirable to use a buffer IC (e.g., 74LS37) having a large current capacity as the inverters F3 and F4. The diode as the full wave rectifier can be a normal switching diode such as 1S1588.

The transistors Q3 and Q7 are turned off only during the period while the control signals S1 and S2 are inputted and are turned on during the other period. Therefore, the gates of the transistors Q3 and Q7 should be always supplied with an energy sufficient for maintaining the turned-on state. In this condition, the method in which the control signals S1 and S2 are supplied to the primary sides of the pulse transformers T1 and T2 without change is not suitable because the transformer that can transmit a low frequency component must be a large size. In the method of this example utilizing a carrier signal, the pulse transformers T1 and T2 are only required to transmit the carrier pulse of approximately 5 MHz, so they can be downsized substantially. For example, it is sufficient to make them by winding a pair of wires having the diameter of 0.4 millimeters ten turns on a toroidal core made of ferrite having the outer contour of 10 millimeters, the inner contour of 5 millimeters and the thickness of 5 millimeters.

In the above-mentioned first through sixth examples, the positive side and the negative side are determined with respect to the GND potential (0 volts) in the circuit examples. However, it is possible to use a positive or a negative potential instead of the GND potential as a reference level and to output a ramp waveform voltage having a higher or a lower potential than the reference level.

SEVENTH EXAMPLE

FIG. 16 is a functional block diagram of a voltage output block pair according to a seventh example. The positive voltage output block 71*g* includes a waveform generation circuit 711 for outputting an increasing voltage signal SV1 when the control signal S1 is active, an impedance conversion circuit 712*g* for reducing an output impedance of the waveform generation circuit 711 and a switch circuit 713 for disconnecting the input of the impedance conversion circuit 712*g* from the waveform generation circuit 711 when the control signal S1 is non-active. The waveform generation circuit 711 includes a capacitance element C1 and a constant-current source 715, and supplies current to the capacitance element C1 so as to generate the increasing voltage waveform. In the same manner, the negative voltage output block 72*g* includes a waveform generation circuit 721, an impedance conversion circuit 722*g* and a switch circuit 723. The waveform generation circuit 721 includes a capacitance element C2 and a constant-current source 725, and outputs an increasing voltage signal SV2 when the control signal S2 is active.

Figure 17:
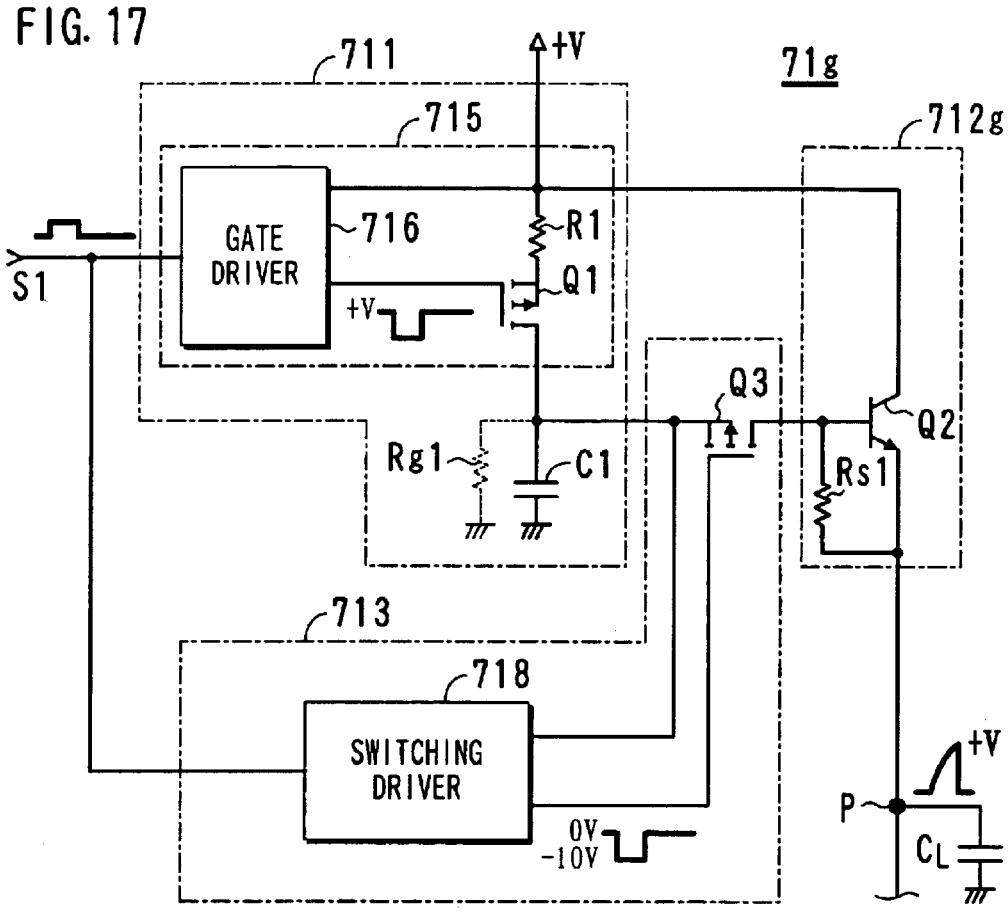
FIG. 17 is a schematic diagram of the positive voltage output block according to the seventh example.
Figure 18:
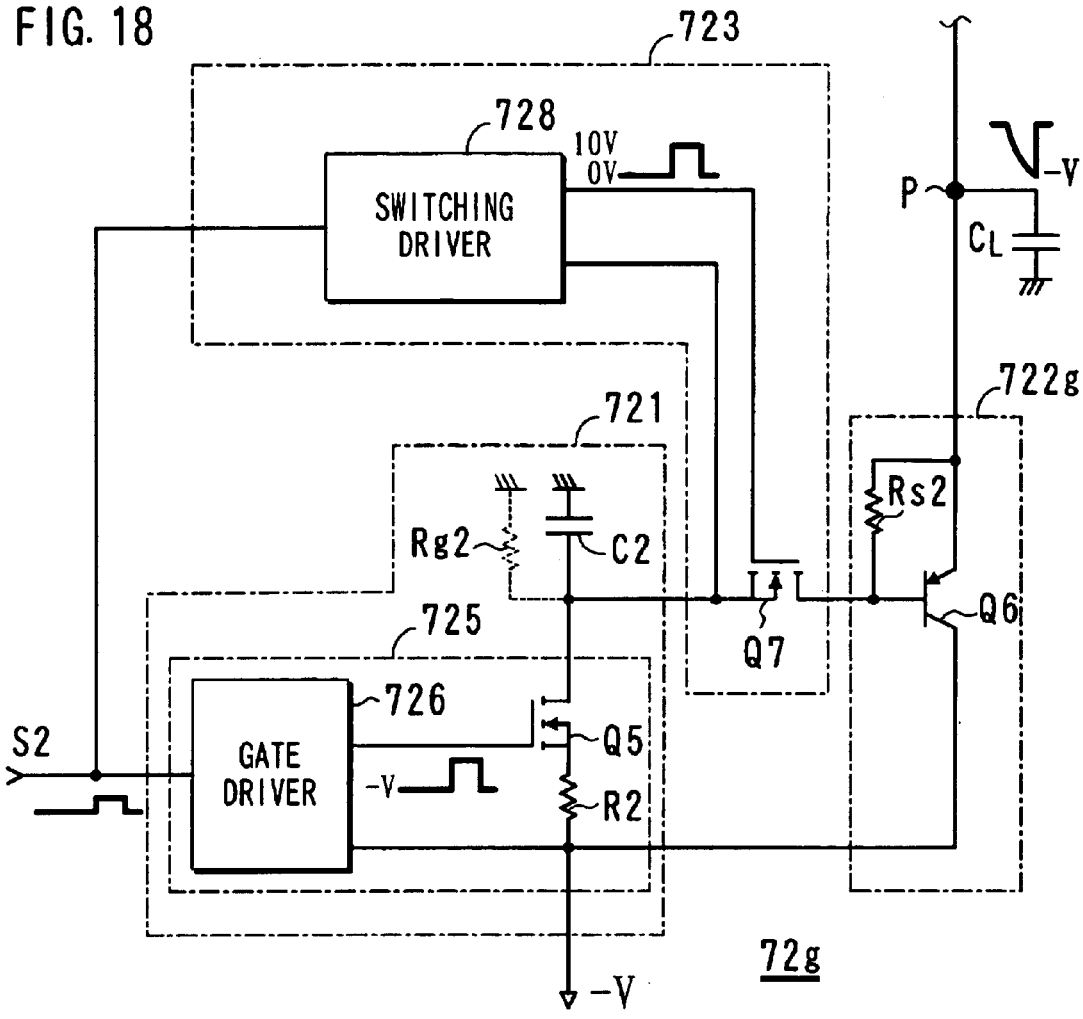
FIG. 18 is a schematic diagram of the negative voltage output block according to the seventh example.

FIG. 17 is a schematic diagram of the positive voltage output block according to the seventh example. FIG. 18 is a schematic diagram of the negative voltage output block according to the seventh example. In the positive voltage output block 71*g*, the constant-current source 715 of the waveform generation circuit 711 includes a P-channel MOS type field-effect transistor Q1, a source resistor R1 and a gate driver 716. The impedance conversion circuit 712*g* is an emitter follower including an NPN type transistor Q2. The switch circuit 713 includes a P-channel MOS type field-effect transistor Q3 and a switching driver 718. When the switch circuit 713 is turned off, the voltage between the base and the emitter is substantially 0 volts because of the resistor Rs1 connected between the base and the emitter of the transistor Q2, so the impedance conversion circuit 712*g* is in non-active state. In the negative voltage output block 72*g*, the constant-current source 725 of the waveform generation circuit 721 includes an N-channel MOS type field-effect transistor Q5, a source resistor R2 and a gate driver 726. The impedance conversion circuit 722*g* is an emitter follower including a PNP type transistor Q6. The switch circuit 723 includes an N-channel MOS type field-effect transistor Q7 and a switching driver 728. When the switch circuit 723 is turned off, the voltage between the base and the emitter is substantially 0 volts because of the resistor Rs2 connected between the base and the emitter of the transistor Q6, so the impedance conversion circuit 722*g* is non-active state. The positive voltage output block 71*g* and the negative voltage output block 72*g* are connected with each other at the output terminal P and constitute a complementary symmetric circuit for the load $C_L$.

Next, a circuit operation of the positive voltage output block 71*g* will be explained as a type.

When the control signal S1 is inputted, the gate driver 716 outputs a signal having the amplitude of −10 volts with respect to the power source potential +V to the gate of the transistor Q1. The control signal S1 is also imparted to the switching driver 718, and the driver output is changed from 0 volts to −10 volts. Thus, the transistor Q3 is turned on and the impedance conversion circuit 712*g* can receive the signal voltage. Supposing that a resistance of the source resistor R1 is r1, the current I=(10 −3)/r1 amperes flows through the drain of the transistor Q1 since the threshold level voltage of the transistor Q1 is approximately 3 volts. Since this current value is determined by the output voltage of the gate driver 716 and the source resistor R1, the constant-current source 715 works without being affected by a state of the load that is connected to the drain of the transistor Q1. The constant-current I charges the capacitance element C1, and a ramp waveform having a constant gradient is generated at the node of the transistor Q1 and the capacitance element C1.

Supposing that a capacitance of the capacitance element C1 is c1, the gradient dV/dt when charging the capacitance element C1 with the constant-current I is I/c1 since I=dQ/dt=c1dV/dt. More specifically, when r1=700 ohms and c1=0.01 microfarads, a ramp waveform having the gradient dV/dt=1 volts per microsecond is generated since I=0.01 amperes. It is desirable that the capacitance element C1 is an element having a withstand voltage higher than +V and is an element such as a laminated film capacitor without a piezoelectric effect. If a ceramic capacitor is used, the capacitance varies in accordance with the applied voltage due to the piezoelectric effect, so that the gradient changes when the power source potential +V is changed. In contrast, if an element having no piezoelectric effect is used, the gradient does not vary even if the power source potential +V is changed, so that the adjustment can be omitted.

The generated ramp waveform passes through the MOS type field-effect transistor Q3 that is turned on at this time point and is supplied to the base of the transistor Q2 of the impedance conversion circuit 712*g*. Since the emitter potential of the transistor Q2 that is connected to the load $C_L$ is the ground potential, i.e., 0 volts, the transistor Q2 is turned on when the voltage of the ramp waveform that is supplied to the base of the transistor QZ exceeds approximately 0.7 volts, and then the ramp waveform after being amplified in current is outputted from the emitter to the load $C_L$. The output impedance of the transistor Q2 whose collector is connected to the ground is $1/h_{FE}$ of the input impedance, e.g., approximately 1/100.

When e.g., 200 microseconds passes after the input of the control signal S1, the control signal S1 becomes non-active. Then, the constant-current source 715 is turned off, and the transistor Q3 is also turned off, so that the base of the transistor Q2 is separated from the ramp waveform generation circuit. At this time point, the transistor Q2 is turned off while the emitter maintains the output potential just before the turning off. Approximately 500 nanoseconds to 1 microseconds after the time point, the ground circuit 73 (see FIG. 5) works, the output terminal P is forced to be cramped to the ground potential and the charge stored in the load $C_L$ is absorbed into the ground circuit 73. The charge stored in the capacitance element C1 is discharged gradually to the ground line via the resistance component of the capacitance element C1. If the discharging time is longer than a one-subframe period, it is better to connect the resistor Rg1 shown by the dotted line in FIG. 17 in parallel with the capacitance element C1. If the value of the resistor Rg1 is too small, the ramp waveform outputted by the waveform generation circuit 711 does not become linear having a constant gradient but becomes an exponential waveform having a little curve. By setting the resistor Rg1 to a value more than 10 kilohms in this circuit, a ramp waveform having no problem in the practical use can be obtained.

According to the above-mentioned operation, the ramp waveform output is obtained. However, in this example, the output waveform does not become linear with a constant gradient but becomes an exponential waveform with a little curve because of the influences of the base current of the transistor Q2 and the current flowing through the resistor Rs1. The curve to some extent does not affect the practical use at all.

The emitter follower adopted as the impedance conversion circuit 712*g* has a feature of being always active even if there is no input signal and its output is connected to the ground line with a low AC impedance. In other words, the output terminal P is regarded as being connected to the ground line via a capacitor having infinite capacitance. In this example, the base and the emitter of the transistor Q2 of the impedance conversion circuit 712*g* are connected with each other via the resistor Rs1, and the input (the base) of the impedance conversion circuit 712*g* is separated from the output of the waveform generation circuit 711 by the switch circuit 713 during the period while the ramp waveform is not outputted. Thus, in the period while the ramp waveform is not outputted, the potential difference between the base and the emitter of the transistor Q2 is maintained at 0 volts by the resistor Rs1, and the transistor Q2 is completely turned off. Therefore, the impedance conversion circuit 712*g* is merely a minute capacitance of approximately 100 picofarads for the output terminal P. If a resistance of the resistor Rs1 is too small, linearity of the ramp waveform becomes deteriorated. If the resistance of the resistor Rs1 is too large, the turned-off state of the transistor Q2 becomes unstable. If a bipolar transistor is used as the transistor Q2 as in this example, an output waveform and an operation with no problem in the practical use within a few kilohms through a hundred and a few ten kilohms can be obtained. The transistor Q1 requires a withstand voltage higher than the difference between the positive power source potential +V and the negative power source potential −V. However, 100 milliamperes is sufficient for the current capacity, so e.g., 2SJ181 can be used as the transistor Q1. The transistor Q2 requires the current capacity of at least a few hundred milliamperes and the withstand voltage equal to the transistor Q1 has. 2SC3840 can be used as the transistor Q2, for example. The transistor Q3 requires a withstand voltage and current capacity equal to the transistor Q1 has. 2SJ181 can be used as the transistor Q3, too.

The above explanation is about the operation at the positive polarity side. However, the negative voltage output block 72*g* works in the same way as the positive voltage output block 71*g* except the difference of the polarity. In a concrete example, 2SK1152 can be used as the transistor Q5 and the transistor Q7, and 2SA1486 can be used as the transistor Q6. The resistance range of the resistor Rs2 is the same as that of the resistor Rs1.

In the seventh example, a bipolar transistor can be used for the constant-current sources 715 and 725 instead of the MOS type field-effect transistors. In this case, the constant-current I becomes $(10-V_{BE})/r1=(10-0.7)/r1$ amperes. The bipolar transistor can be used as a switching element also in the switch circuits 713 and 723. There is another variation in which a current limiting resistor is inserted between the base of the transistor Q2 or Q6 of the impedance conversion circuit 712 or 722 and the switch circuit 713 or 723 so as to optimize the operation. Instead of supplying the control signals S1 and S2 to the switching drivers 718 and 728 without change, it is possible to supply another switching control signal having a timing that is a little different from that of the control signals S1 and S2, so as to optimize the entire circuit operation.

EIGHTH EXAMPLE

Figure 19:
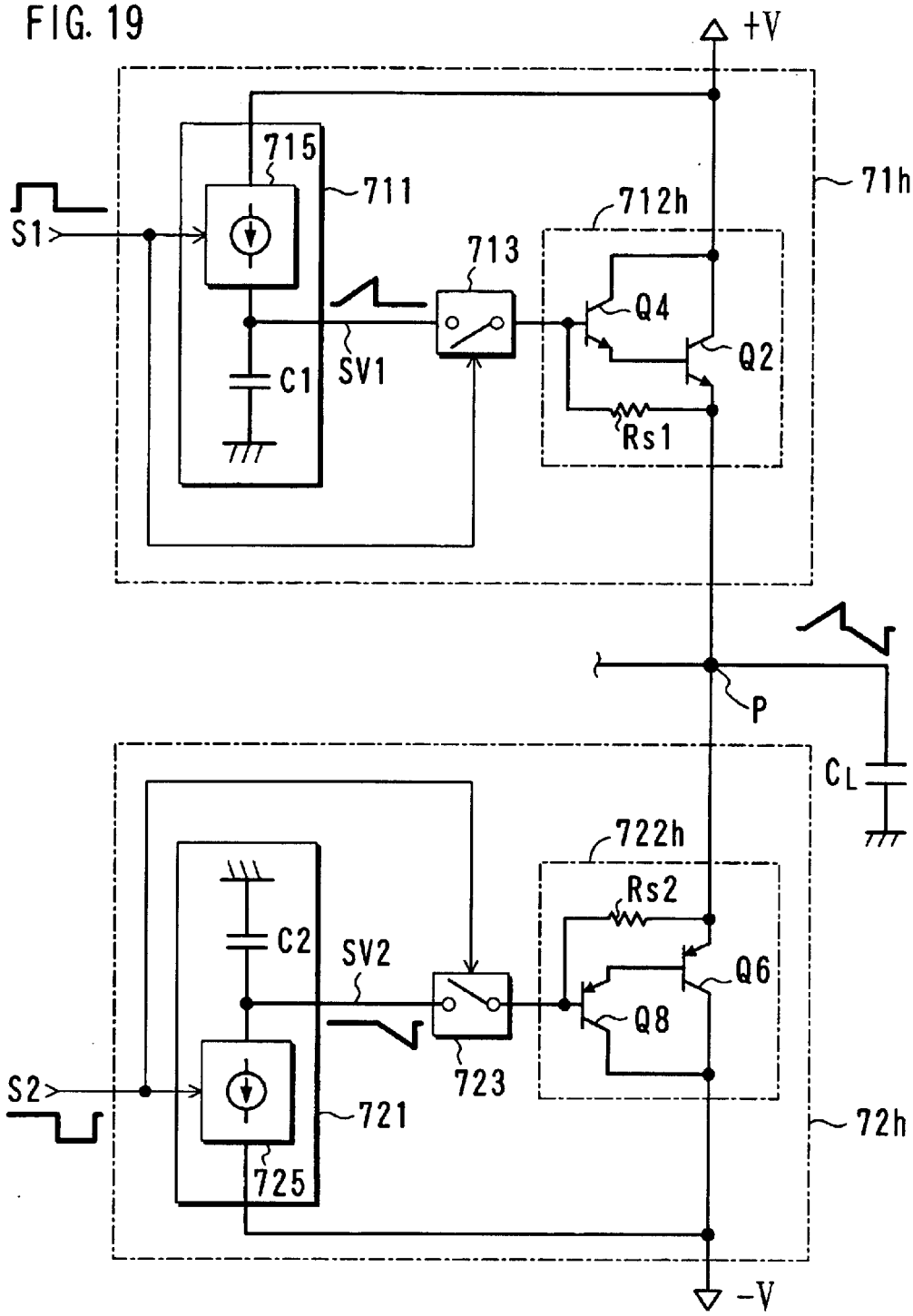
FIG. 19 is a schematic diagram of a voltage output block pair according to an eighth example.

FIG. 19 is a schematic diagram of a voltage output block pair according to an eighth example. In the eighth example, the positive voltage output block 71*h* and the negative voltage output block 72*h* have a feature that the impedance conversion circuits 712*h* and 722*h* include plural transistors in Darlington connection.

The above-mentioned seventh example has a sufficient capacity for a driving circuit of a small size panel having a small load $C_L$ whose total sum of current value due to microdischarge and the ramp waveform is less than a few ten milliamperes. However, there is a problem when driving a large size PDP of 42 inches or more whose total sum of current reaches a few hundred milliamperes. Namely, as the current increases, a variation of the gradient with respect to the output current increases. This phenomenon is caused by a base current of the impedance conversion circuit. Supposing that the output current of the impedance conversion circuit is Ic, the current of $Ib=Ic/h_{FE}$ flows through the base. In the seventh example, since the $h_{FE}$ is approximately 100, the base current flowing into the impedance conversion circuit is 0.5 milliamperes when the output current is 50 milliamperes. On the other hand, the constant-current sources 715 and 725 are generating current I=10 milliamperes when r1=700 ohms. In the explanation of the seventh example, it was assumed that the whole current charges the capacitance element C1 for calculation. However, the real charging current is I−Ib, and the current of 9.5 milliamperes actually charges the capacitance element C1 in the example. Therefore, in order to make the charging current 10 milliamperes, the current of the constant-current sources 715 and 725 should be 10.5 milliamperes. Accordingly, the resistance r1 of the source resistor R1 should be 667 ohms. For driving a large size PDP in which the output current of the impedance conversion circuits 712*h* and 722*h* becomes 500 milliamperes, the base current becomes 5 milliamperes that is a half of the current of the constant-current sources 715 and 725, and the charging current of the capacitance element C1 is reduced to 5 milliamperes. Even if the resistance r1 is changed so that the current of 15 milliamperes flows, the output current becomes 250 milliamperes when microdischarge is not generated. Therefore, the base current becomes 2.5 milliamperes, and the current of 12.5 milliamperes charges the capacitance element C1. Namely, if the value of the base current cannot be neglected compared with the charging current of the capacitance element C1, the charging current of the capacitance element C1 varies in accordance with the variation of the output current, though it is important for generating a ramp waveform having a constant gradient. In order to solve this problem, the Darlington connection is utilized in the eighth example.

It is known that the current amplification of the Darlington connection is the product of the current amplifications of the transistors. For example, if 2SC4002 is used for the transistor Q4 of the impedance conversion circuit 712*b* and 2SC3840 is used for the transistor Q2, the total current amplification is 100×100=10000 since each $h_{FE}$ of the transistors Q4 and Q2 is approximately 100. Therefore, the base current becomes 0.05 milliamperes when the output current is 500 milliamperes, while it is 0.025 milliamperes when the output current is 250 milliamperes. A variation of the base current depending on the microdischarge is 0.25% of the charging current of the capacitance element C1 that is 10 milliamperes, so the variation can be neglected. The Darlington connection is not limited to two stages but can be three or four stages in accordance with the necessity. In the eighth example, the resistor Rs1 for keeping the impedance conversion circuit 712*h* in off state when the control signal S1 is not inputted is disposed so as to connect the input of the impedance conversion circuit 712*h* to the output thereof. The range of the resistance is the same as that in the seventh example.

The effect of the Darlington connection of the transistors Q8 and Q6 of the impedance conversion circuit 722*h* at the negative polarity side is the same as that of the impedance conversion circuit 712*h* at the positive polarity side. 2SA1699 can be used as the transistor Q8 and 2AS1486 can be used as the transistor Q6.

According to the eighth example, the influence of the input current of the impedance conversion circuit decreases compared with that in the seventh example, so the variation of the gradient of the ramp waveform with respect to the variation of the load current decreases. In addition, a ramp waveform output whose gradient is close to a line can be obtained.

NINTH EXAMPLE

Figure 20:
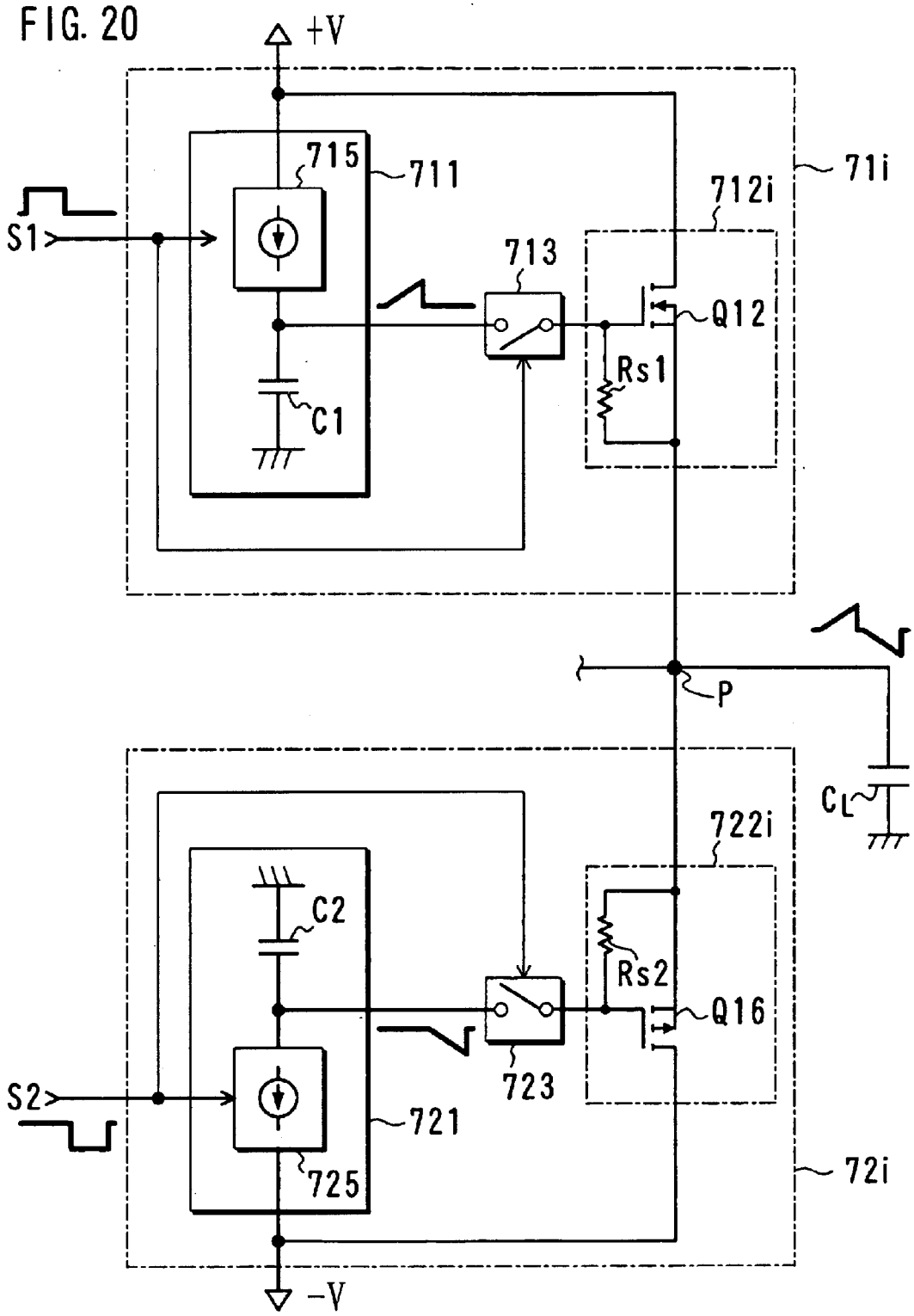
FIG. 20 is a schematic diagram of a voltage output block pair according to a ninth example.

FIG. 20 is a schematic diagram of a voltage output block pair according to a ninth example. In the ninth example, the positive voltage output block 71*i* and the negative voltage output block 72*i* have a feature that a source follower including field-effect transistors Q12 and Q16 is adopted as the impedance conversion circuits 712*i* and 722*i*. The problem of blunting the waveform in the seventh example is caused by the base current of the bipolar transistor. When the field-effect transistors Q12 and Q16, which are voltage control elements, are used for making the impedance conversion circuits 712*i* and 722*i*, the problem caused by the base current can be solved. Since the input impedance between the gate and the source of the field-effect transistor is much higher than the input impedance between the base and the emitter of the bipolar transistor, the resistance of the resistors Rs1 and Rs2 for keeping the impedance conversion circuits 712*i* and 722*i* in off state when the control signals S1 and S2 are not inputted can be very large value such as a few hundred kilohms to a few ten megohms.

In the ninth example, a ramp waveform generated by charging the capacitance element C1 is supplied to the gate of the transistors Q12 and Q16 via the switch circuits 713 and 723. A low impedance ramp waveform output appears at sources of the transistors Q12 and Q16 whose drains are connected to the ground. Differently from the seventh example and the eighth example, the current that flows from the waveform generation circuit 711 or 721 via the switch circuit 713 or 723 to the impedance conversion circuit 712*i* or 722*i* is equal to the current that flows through the resistor Rs1 or Rs2, so the value is much smaller. Thus, the Q factor of the capacitance element C1 becomes very large, and the amplitude of the ramp waveform increases linearly substantially according to the theory. Since the value of the output current hardly affects the input side, a ramp waveform with a constant gradient can be supplied to the PDP 1 regardless of the output current. 2SK2405 and 2SJ459 can be used as the transistors Q12 and Q16. Other voltage control elements such as an insulated gate bipolar transistor (IGBT) or a junction type FET can be used instead of the MOS-FET. It is also possible to insert a resistor in the gate circuit for suppressing an undesired oscillation.

TENTH EXAMPLE

Figure 21:
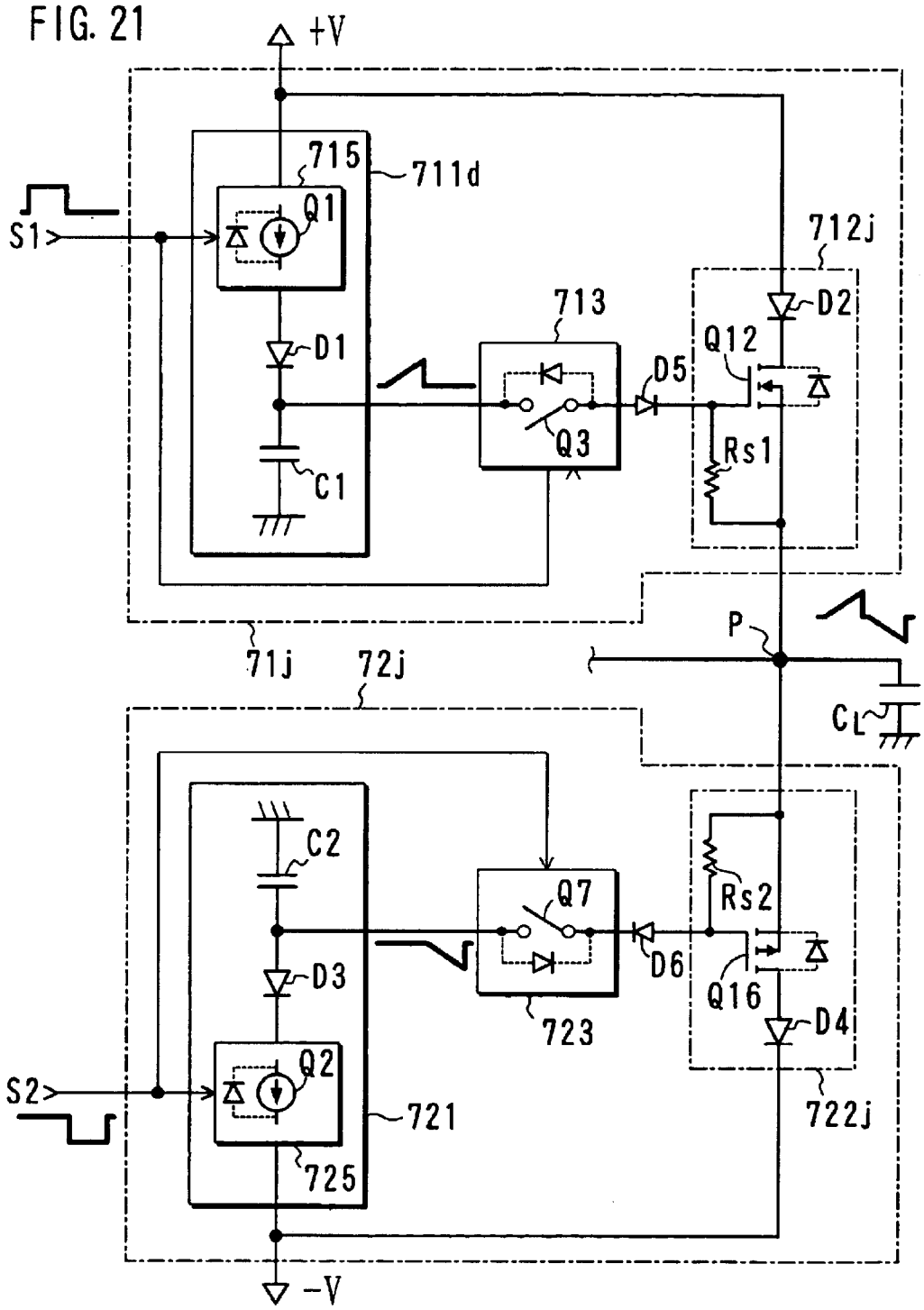
FIG. 21 is a schematic diagram of a voltage output block pair according to a tenth example.

FIG. 21 is a schematic diagram of a voltage output block pair according to a tenth example. In the tenth example, the positive voltage output block 71*j* and the negative voltage output block 72*j* have a feature that diodes D5 and D6 for preventing a backflow are disposed between the switch circuit 713 and the input terminal of the impedance conversion circuit 712*j* as well as between the switch circuit 723 and the input terminal of the impedance conversion circuit 722*j*, and that the impedance conversion circuits 712*j* and 722*j* include diodes D2 and D4 for preventing a short circuit to the power source.

In the above-mentioned seventh example through the ninth example, it is a precondition that the power source voltages +V and −V for generating ramp waveforms are higher than the power source voltage of other driving circuits including the sustain circuit 67 and the scan circuit 66. However, the power source voltage of other driving circuits can be higher depending on the panel structure or the driving circuit structure. This example can deal with this condition.

As shown by the broken line in FIG. 21, a parasitic diode is connected between the drain and the source of each of the transistors Q1, Q2, Q3, Q7, Q12 and Q16 in the opposite direction to the polarity of the element without exception. This is due to the structure of a MOS-FET. Supposing that the potential of the output terminal P becomes higher than the power source potential +V when diodes D1 and D2 do not exist in the positive voltage output block 71*j*, the output terminal P is connected to the power source via the path including P and Q12. In addition, wasteful current may flow in the path including P, Rs1, Q3 and Q1 that is not a direct short circuit, or the capacitor voltage may vary due to charging or discharging in the path including P, Rs1, Q3 and C1. The diodes D1, D2 and D5 cut off these paths so as to prevent the short circuit to the power source and to prevent the wasteful current from flowing. When the normal ramp waveform is generated, the diodes D1 and D2 are biased in the forward direction. Therefore, the circuit operation is not affected at all though there is a voltage drop of approximately 0.7 volts. The diodes D1 and D2 must have a withstand voltage of Vm−(+V) volts when Vm is the maximum potential of the output terminal P. The diode D1 must have a current capacity more than 100 milliamperes, while the diode D2 must have a current capacity more than a few hundred milliamperes. It is the same concerning the negative polarity side block. 1NZ61 can be used as the diodes D1, D3, D5 and D6, and G16S can be used as the diodes D2 and D4.

ELEVENTH EXAMPLE

Figure 22:
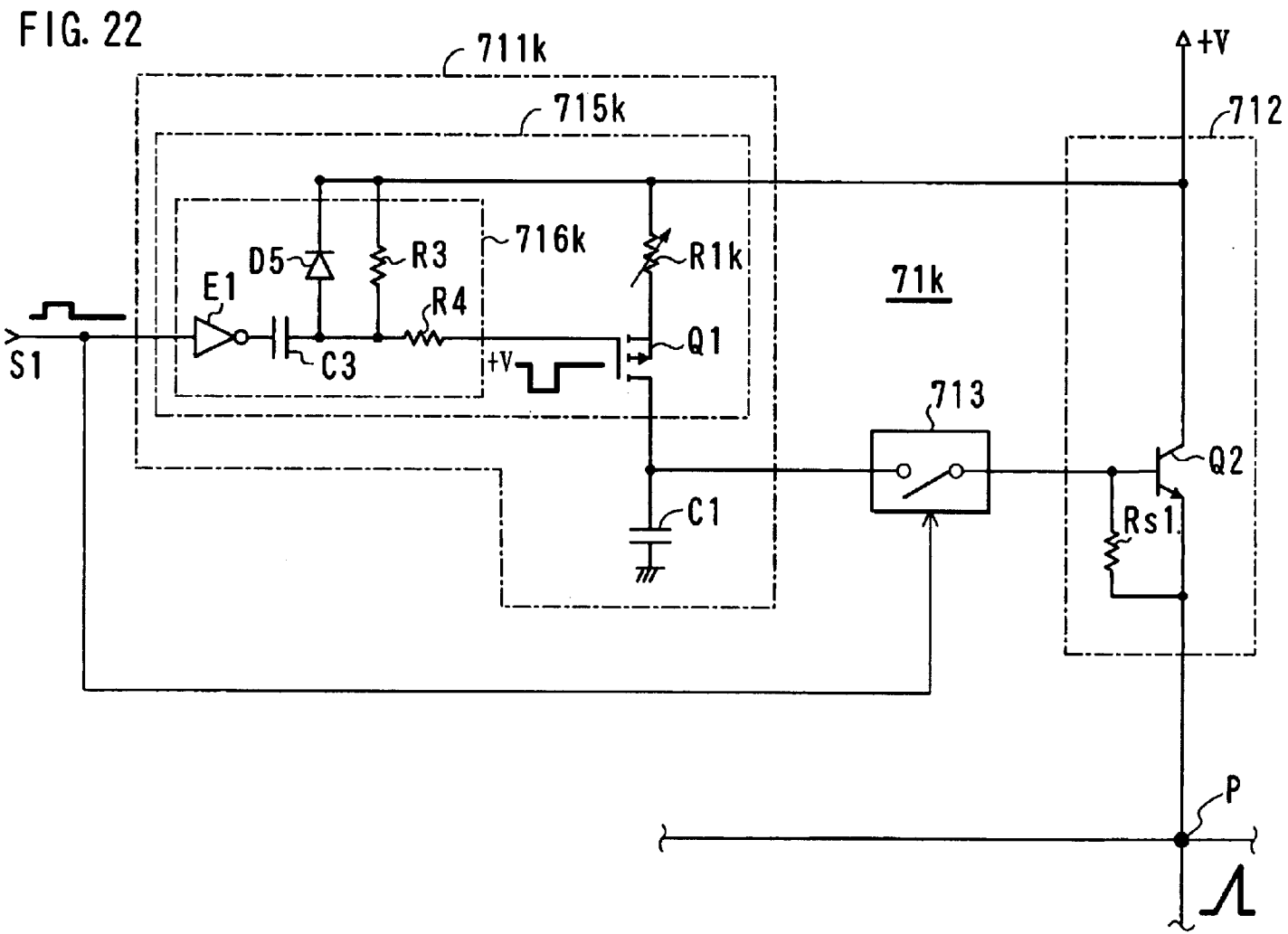
FIG. 22 is a schematic diagram of a positive voltage output block according to an eleventh example.
Figure 23:
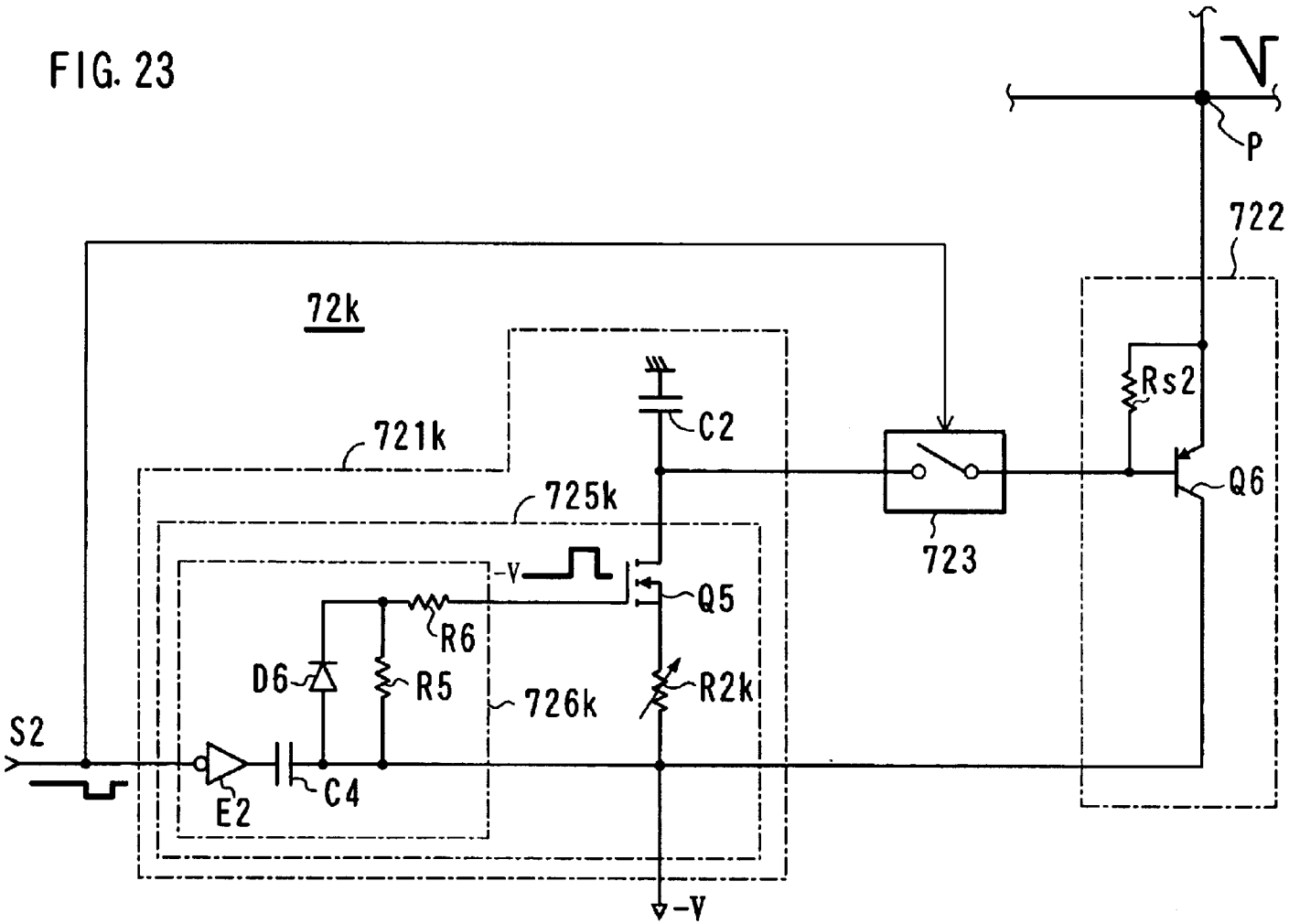
FIG. 23 is a schematic diagram of the negative voltage output block according to the eleventh example.

FIG. 22 is a schematic diagram of a positive voltage output block according to a eleventh example. FIG. 23 is a schematic diagram of the negative voltage output block according to the eleventh example. In the eleventh example, the positive voltage output block 71*k* and the negative voltage output block 72*k* have a feature that the constant-current sources 715*k* and 725*k* of the waveform generation circuits 711*k* and 721*k* include gate drivers 716*k* and 726*k* without a floating power source and include variable resistors R1*k* and R2*k*.

Figure 24:
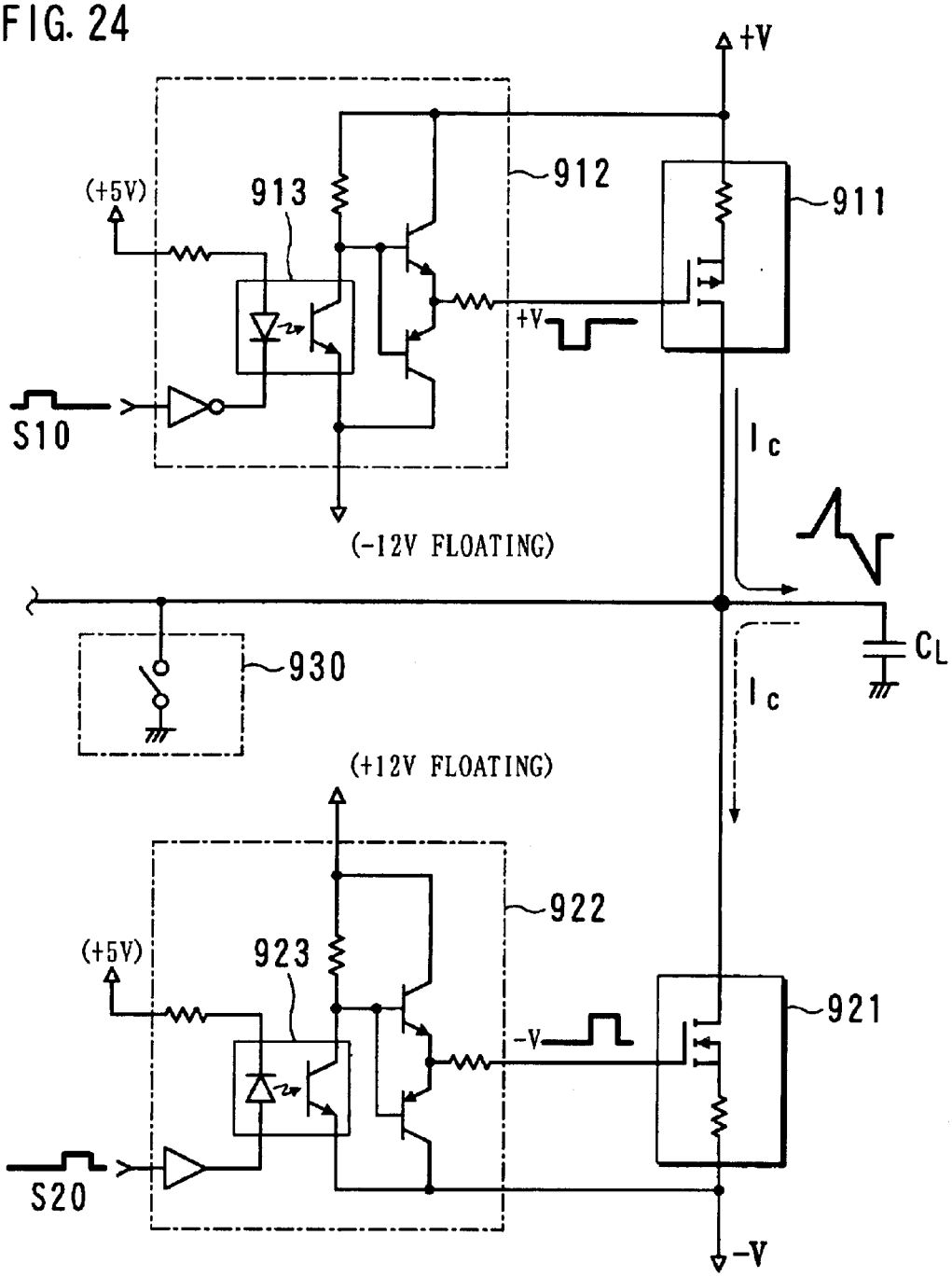
FIG. 24 is a schematic diagram of the conventional driving circuit.
Figure 25:
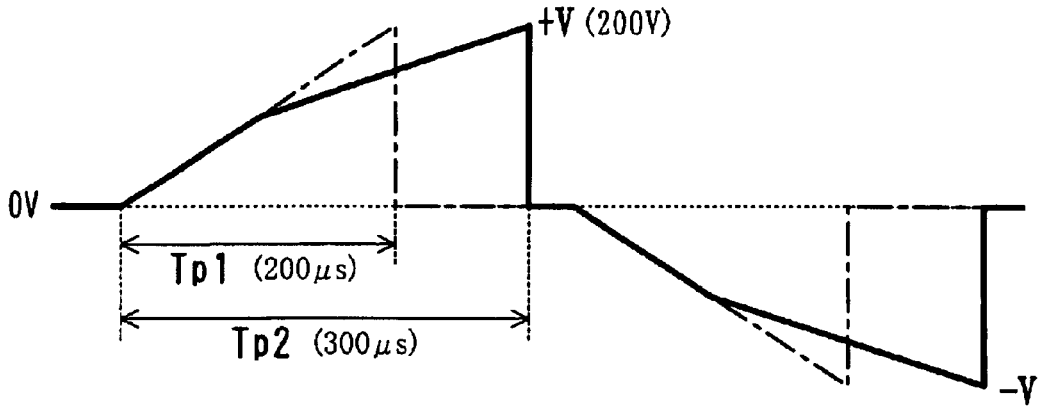
FIG. 25 shows a transition of the driving voltage in the conventional method.

Each of the gate drivers 912 and 922 shown in FIG. 24 receives the control signal S10 or S20 by a photocoupler and outputs a signal with the amplitude of approximately 10 volts that is isolated from the input signal concerning a potential. In this structure, floating power sources of +12 volts and −12 volts isolated from the ground line are necessary at the output side of the photocoupler. However, there is a desire not to use the floating power source for reducing a cost of the circuit. This example is aimed to satisfy the desire.

The gate driver 716*k* of the positive polarity side includes a pulse amplifier E1 for inverting and amplifying the control signal S1 with a logic level to the amplitude of approximately 10 volts, a coupling capacitor C3 for separating potentials, a cramp diode D5, a cramp resistor R3 and a gate resistor R4. In the same way, the gate driver 726*k* of the negative polarity side includes a pulse amplifier E2, a coupling capacitor C4, a cramp diode D6, a cramp resistor R5 and a gate resistor R6. In the constant-current sources 715*k* and 725*k*, the source resistors R1*k* and R2*k* for determining the output current value can be fixed but are variable resistors in this example so that the current can be set at any value.

The circuit operation of the positive polarity side will be explained as a type. The control signal S1 amplified by the pulse amplifier E1 is applied to the gate of the transistor Q1 via the coupling capacitor C3. The coupling capacitor C3, the diode D5 and the resistor R3 constitute a cramp circuit having a time constant C3×R3. If the time constant is sufficiently larger than the pulse width of the input control signal, the output signal of the pulse amplifier El becomes a pulse signal that drops to +V−10 volts with respect to the power source potential +V. The gate resistor R4 is an element having the resistance of a few ten ohms for stabilizing the operation and does not affect the amplitude of the pulse signal. For example, when a capacitance of the coupling capacitor C3 is 0.1 microfarads and a resistance of R3 is 220 kilohms, the time constant becomes 22 milliseconds. As a result, a drop of the amplitude (a sag) in a flat portion of the pulse is restricted less than 1% even if the pulse width of the control signal is 200 microseconds. The IC TC4425 can be used for the pulse amplifier E1, and 1S1588 (a small signal diode) can be used as the diode D5.

Supposing that a resistance of the source resistor R1*k* is r1*k*, the current I=(10−3)/r1*k* amperes flows through the drain of the transistor Q1 since the threshold level voltage of the transistor Q1 is approximately 3 volts. Therefore, if the resistance r1*k* is variable, the drain current of the transistor Q1 can be set freely.

The components and the operation at the negative polarity side shown in FIG. 23 are the same as those at the positive polarity side except that the polarity of the signal is opposite. TC4423 as the pulse amplifier E1 includes two inverting amplifiers, so the remaining half can be used for the pulse amplifier E2. The gate driver 716*k* at the positive polarity side can be used as a switching driver for driving the switch circuit 713 at the positive polarity side, and the gate driver 726*k* at the negative polarity side can be used as a switching driver for driving the switch circuit 723 at the negative polarity side, without change.

In the above-mentioned first through eleventh examples, the positive side and the negative side are determined with respect to the GND potential (0 volts) in the circuit examples. However, it is possible to use a positive or a negative potential instead of the GND potential as a reference level and to output a ramp waveform voltage having a higher or a lower potential than the reference level.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A method driving a plasma display panel, which comprises a display screen and an impedance conversion circuit, the method comprising:

supplying an increasing voltage signal to the impedance conversion circuit in which an output impedance is lower than an input impedance; and supplying a signal corresponding to the increasing voltage signal outputted by the impedance conversion circuit to the cells of the display screen during a reset period to equalize charges of the cells.

2. A display driving device applying an increasing voltage equalize charges of cells of a display screen to a plasma display panel, the device comprising:

a waveform generation circuit, comprising a capacitance element and a constant-current source, supplying current to the capacitance element when a control signal is active so as to generate an increasing voltage waveform;

an impedance conversion circuit reducing an output impedance of the waveform generation circuit; and a switch circuit connecting an input terminal of the impedance conversion circuit to an output terminal of the impedance conversion circuit when the control signal is not active.

3. The display driving device according to claim 2, wherein the impedance conversion circuit includes a plurality of transistors in Darlington connection.

4. The display driving device according to claim 2, wherein the impedance conversion circuit includes a voltage control type transistor.

5. The display driving device according to claim 2, wherein a diode preventing a backflow is disposed between the capacitance element and the constant-current source.

6. The display driving device according to claim 2, further comprising:

a resistor disposed between the capacitance element and the constant-current source.

7. The display driving device according to claim 2, wherein the control signal is supplied to the constant-current source via a clamp circuit to convert the control signal to a signal with respect to a power source potential as a reference of displacement.

8. The display driving device according to claim 2, further comprising:

a resistor determining an output current value of the constant-current source, wherein the resistor is a variable resistor.

9. The display driving device according to claim 2, further comprising:

a pair of the waveform generation circuits, a pair of the impedance conversion circuits and a pair of the switch circuits, wherein each of the pair circuits constitutes a complementary symmetric circuit including semiconductor elements having different polarities for applying a first increasing voltage having the positive gradient and a second increasing voltage having the negative gradient to the plasma display panel.

10. A display driving device applying an increasing voltage to equalize charges of cells of a display screen to a plasma display panel, the device comprising:

a waveform generation circuit, comprising a capacitance element and a constant-current source, supplying current to the capacitance element when a control signal is active so as to generate an increasing voltage waveform;

an impedance conversion circuit reducing an output impedance of the waveform generation circuit; and a switch circuit connecting an input terminal of the impedance conversion circuit to an output terminal of the impedance conversion circuit when the control signal is not active, wherein the switch circuit comprises a switching driver comprising a pulse transformer and a switching element that is turned on or off by the switching driver, and the primary side of the pulse transformer is supplied with a pulse train modulated by the control signal, while the switching element is controlled by a signal that is a result of rectifying the secondary output of the pulse transformer in full wave.

11. A display driving device applying an increasing voltage to equalize charges of cells of a display screen to a plasma display panel, the device comprising:

a waveform generation circuit, comprising a capacitance element and a constant-current source, supplying current to the capacitance element when a control signal is active so as to generate an increasing voltage waveform;

an impedance conversion circuit reducing an output impedance of the waveform generation circuit; and a switch circuit disconnecting an output of the waveform generation circuit from an input of the impedance conversion circuit so as to turn off the impedance conversion circuit when the control signal is not active.

12. The display driving device according to claim 11, wherein the impedance conversion circuit comprises a resistor connecting an input terminal of the impedance conversion circuit to an output terminal of the impedance conversion circuit.

13. The display driving device according to claim 11, wherein the impedance conversion circuit includes a plurality of transistors in Darlington connection.

14. The display driving device according to claim 11, wherein the impedance conversion circuit includes a voltage control type transistor.

15. The display driving device according to claim 11, wherein a diode preventing a backflow is disposed between the switch circuit and the input terminal of the impedance conversion circuit.

16. The display driving device according to claim 11, wherein the control signal is supplied to the constant-current source via a clamp circuit to convert the control signal to a signal with respect to a power source potential as a reference of displacement.

17. The display driving device according to claim 11, further comprising:

a resistor determining an output current value of the constant-current sources, wherein the resistor is a variable resistor.

18. The display driving device according to claim 11, further comprising:

a pair of the waveform generation circuits, a pair of the impedance conversion circuits and a pair of the switch circuits, wherein each of the pair circuits constitutes a complementary symmetric circuit including semiconductor elements having different polarities for applying a first increasing voltage having the positive gradient and a second increasing voltage having the negative gradient to the plasma display panel.

* * * * *

UNITED STATES PATENT AND TRADEMARK OFFICE

CERTIFICATE OF CORRECTION

PATENT NO. : 6,937,213 B2
DATED : August 30, 2005
INVENTOR(S) : Seiichi Iwasa et al.

It is certified that error appears in the above-identified patent and that said Letters Patent is hereby corrected as shown below:

Column 22,
Line 34, after "voltage" insert -- to --.

Column 24,
Line 31, change "sources" to -- source --.

Signed and Sealed this

Second Day of May, 2006

JON W. DUDAS
*Director of the United States Patent and Trademark Office*